US008272828B2

(12) United States Patent
Kosuge et al.

(10) Patent No.: US 8,272,828 B2
(45) Date of Patent: Sep. 25, 2012

(54) OBJECT MOVING APPARATUS

(75) Inventors: Kazuhiro Kosuge, Sendai (JP); Yasuhisa Hirata, Sendai (JP); Mitsuru Endo, Sendai (JP); Koki Suzuki, Tokyo (JP); Takashi Kanbayashi, Tokyo (JP); Mitsukazu Ohmoto, Tokyo (JP); Kei Akune, Tokyo (JP); Hiroyuki Arai, Tokyo (JP); Hiroyuki Shinozuka, Tokyo (JP)

(73) Assignees: IHI Transport Machinery Co., Ltd., Tokyo (JP); Tohoku University, Sendai-shi (JP)

( * ) Notice: Subject to any disclaimer, the term of this patent is extended or adjusted under 35 U.S.C. 154(b) by 256 days.

(21) Appl. No.: 12/740,305

(22) PCT Filed: Oct. 28, 2008

(86) PCT No.: PCT/JP2008/003062

§ 371 (c)(1),
(2), (4) Date: Jul. 21, 2010

(87) PCT Pub. No.: WO2009/057279

PCT Pub. Date: May 7, 2009

(65) Prior Publication Data

US 2010/0300837 A1 Dec. 2, 2010

(30) Foreign Application Priority Data

Oct. 29, 2007 (JP) ..... 2007-280288
May 29, 2008 (JP) ..... 2008-140432

(51) Int. Cl.
*E04H 6/24* (2006.01)

(52) U.S. Cl. ..... 414/239; 414/253; 414/259

(58) Field of Classification Search ..... 198/464.1, 198/465.1; 414/239, 240, 242, 253, 259
See application file for complete search history.

(56) References Cited

U.S. PATENT DOCUMENTS 5,190,427 A * 3/1993 Lai ..... 414/278
(Continued)

FOREIGN PATENT DOCUMENTS

JP 04203176 A * 7/1992
(Continued)

OTHER PUBLICATIONS

Kosuge, K. et al., "Decentralized Control of Multiple Mobile Robots Handling a Single Object in Coordination", Journal of the Robotics Society of Japan, vol. 16, No. 1, pp. 87-95 (Jan. 15, 1998).

*Primary Examiner* — Mark A Deuble
(74) *Attorney, Agent, or Firm* — Oblon, Spivak, McClelland, Maier & Neustadt, L.L.P.

(57) ABSTRACT

An object moving apparatus is provided which is different from coordinated conveyance through real-time information exchange between carriages only by wireless communication and which can move an object reliably and in a more stable manner by coordinated control of carriages without the object falling off. Arranged is a leader carriage A with a carriage body 2 travelable in all directions by travel drivers 1 and a lifter 5 attached to the carriage body via a link mechanism 3 for lifting up a vehicle 4 as object. The leader carriage is movable along a given target track. Further arranged is a follower carriage B with a carriage body 2 travelable in all directions and a lifter 5 attached to the carriage body via a link mechanism 3 for lifting up the vehicle 4. The follower carriage estimates and follows movement of the leader carriage so as to move the vehicle 4 in coordination with the leader carriage.

12 Claims, 25 Drawing Sheets

U.S. PATENT DOCUMENTS

| | | | | |
|---|---|---|---|---|
| 6,595,141 | B2 * | 7/2003 | Ishikawa et al. | 104/163 |
| 2006/0283687 | A1 * | 12/2006 | Heinemeier et al. | 198/345.3 |

FOREIGN PATENT DOCUMENTS

| | | | |
|---|---|---|---|
| JP | 06307113 | A * | 11/1994 |
| JP | 7 119331 | | 5/1995 |
| JP | 2004 169451 | | 6/2004 |
| JP | 2004169451 | A * | 6/2004 |
| JP | 2004 344435 | | 12/2004 |
| JP | 2005329935 | A * | 12/2005 |
| JP | 2006001661 | A * | 1/2006 |
| JP | 2007 111826 | | 5/2007 |

* cited by examiner ( a )

( b )

( a )

( b )

OBJECT MOVING APPARATUS

TECHNICAL FIELD

The present invention relates to an object moving apparatus.

BACKGROUND ART

State-of-the-art technology for a loading and unloading apparatus adapted to convey a vehicle stopped in any position to a predetermined position in a parking facility is disclosed, for example, in Patent Literature 1.

An apparatus disclosed in Patent Literature 1 comprises left and right conveyance carriages each provided with vehicle support and travel mechanisms. The conveyance carriages cooperate to support and convey a vehicle while each moving independently.

The cooperation of the conveyance carriages is through real-time information exchange via wireless communication. [Patent Literature 1] JP 2004-169451A

SUMMARY OF INVENTION

Technical Problems

However, since the left and right conveyance carriages cooperate on the basis of real-time information exchange through mutual wireless communication as described above, sometimes the flow of information may be interrupted or delayed due to any communication difficulties. Thus, it is difficult to obtain the real-time information necessary for cooperation between the left and right conveyance carriages in a stable manner. When information is not obtained in a stable manner, a stress or internal force greater than necessary may be imposed on the object such as the vehicle being conveyed; in a worst case the object may fall off and/or suffer damage.

The invention was made in view of the above and has its object to provide an object moving apparatus which is different from the above described coordinated conveyance through real-time information exchange between the carriages only by wireless communication and which can move an object such as a vehicle in a more reliable and more stable manner by coordinated control of plural carriages without the object falling off and/or suffering damage.

Solution to Problems

The invention is directed to an object moving apparatus, characterized by comprising:

a leader carriage comprising a carriage body travelable in all directions by travel drivers and a lifter attached to said carriage body via a link mechanism for lifting up an object, said leader carriage being movable along a given target track; and a follower carriage comprising a carriage body travelable in all directions and a lifter attached to said carriage body via a link mechanism for lifting up said object, said follower carriage estimating and following movement of said leader carriage so as to move the object in coordination with said leader carriage.

By the above means, following effects will be obtained.

With the apparatus thus constructed, when the leader carriage moves along the given target track with the object such as the vehicle being lifted up by the lifters of the leader and follower carriages, the follower carriage can estimate and follow the movement of the leader carriage so as to move the object in coordination with the leader carriage. In the control method based upon real-time information exchange between the carriages by wireless communication, there is no fear that the object such as the vehicle may fall down and/or suffer damage due to interruption or delay of information because of communication breakdown.

The object moving apparatus may comprise:

traveling actuators for movement of said carriage body of said leader carriage in a desired direction;

force sensors installed in said link mechanism of said leader carriage for detecting as force information interaction force between the leader and follower carriages via the object;

track sensors for detecting actual track information of said carriage body of said leader carriage;

a wireless communication device for transmitting control information to said follower carriage;

a leader control for outputting, on the basis of target track information, the force information detected by said force sensors of said leader carriage and the actual track information detected by said track sensors of said leader carriage, electric current command values to said traveling actuators of said carriage body of said leader carriage for movement of said carriage body of said leader carriage along the target track, said leader control also sending control information to said follower carriage via said wireless communication device;

traveling actuators for movement of said carriage body of said follower carriage in a desired direction;

force sensors installed in said link mechanism of said follower carriage for detecting as force information interaction force between the leader and follower carriages via the object;

track sensors for detecting actual track information for said carriage body of said follower carriage;

a wireless communication device for receiving the control information from said leader carriage; and a follower control for outputting, on the basis of the force information detected by said force sensors of said follower carriage, the actual track information detected by said track sensors of said follower carriage and the control information received from said leader carriage by the wireless communication device, electric current command values to said traveling actuators of said carriage body of said follower carriage so that the carriage body of said follower carriage may follow the movement of said leader carriage.

As a result, it becomes possible to alleviate various disturbing factors by the control information from the leader carriage via the wireless communication device to thereby move the object such as the vehicle more stably in coordination of the leader and follower carriages.

The link mechanism may be provided by a parallel linkage comprising a plurality of link members arranged on a single horizontal plane, each of the link members serving as a force sensor and having one and the other ends connected through universal joints to the carriage body and the lifter, respectively, the lifter being arranged on the carriage body through the parallel linkage such that constrained in total are three planar degrees of freedom, i.e. two degrees of freedom to move in X and Y directions in the horizontal plane and one degree of freedom in a direction to rotate around a Z-axis orthogonal to the X and Y direction while made free are three degrees of freedom in total, i.e. one degree of freedom in a direction to rotate around the X-axis, one degree of freedom in a direction to rotate around the Y-axis and one degree of freedom in a direction to move along the Z-axis.

In this case, it is preferable that each of said link members comprises the force sensor with rods at opposite ends of the sensor, respectively.

Alternatively, the link member may comprise at least one of a displacement detectable spring and a displacement detectable damper.

The link mechanism may be alternatively provided by a spatial parallel linkage comprising a plurality of spatially arranged link members each serving as force sensor and each with one end linked on the side of the carriage body by a universal joint and the other end linked on the side of the lifter by a universal joint, the lifter being arranged on the carriage body via the spatial parallel linkage such that constrained in total are six degrees of freedom, i.e. two degrees of freedom to move in X-Y directions in a horizontal plane, one degree of freedom in a direction to rotate around a Z-axis orthogonal to the X-axis and Y-axis directions, one degree of freedom in a direction to rotate around the X-axis, one degree of freedom in a direction to rotate around the Y-axis and one degree of freedom to move along the Z-axis direction.

In this case, said link member may comprise at least one of a displacement detectable spring and a displacement detectable damper.

Moreover, the traveling wheels of said carriage body may be omni-directional mobile wheels.

In this case, each of the omni-direction mobile wheels may be provided by a mecanum wheel comprising a wheel body circumferentially provided with a plurality of roller shafts tilted at 45° with respect to a wheel axle and with rollers each rotatably fitted over each of the roller shafts.

Alternatively, each of the omni-direction mobile wheel may comprise a plurality of wheel units provided along the wheel axle, each of the wheel units comprising a wheel body circumferentially provided with a plurality of roller shafts extending tangentially and perpendicular to the wheel axle and with rollers each rotatably fitted over each of the roller shafts.

In the object moving apparatus, the object may be a vehicle; each of the lifters may be provided with wheel raising supports each for support of each of the wheels of said vehicle; and each of the wheel raising supports may comprise:

a pair of rack guide rails secured to extend in parallel with each other within a lifter frame attached to the carriage body via the link mechanism;

a drive guide rail secured to extend in parallel with said rack guide rails;

a pair of rack members slidably arranged along the rack guide rails and having rack portions vertically confronting each other;

a lift bar opening/closing actuator slidably arranged along said drive guide rail;

a drive pinion meshed with both of the mutually confronting rack portions of the paired of rack members and rotationally driven by said lift bar opening/closing actuator;

lift bars each having a wheel support roller rotatably fitted over the bar and ground support wheels at base and tip ends of the bar and projected one and the other ends of the one and the other rack members at right angles thereto, respectively; and a self-aligned-position retainer arranged for keeping the lift bar opening/closing actuator at a desired position on said drive guide rail;

the paired lift bars of each of the wheel raising supports of the lifter being positioned fore and aft of the corresponding wheel of the vehicle and being adapted to be moved toward each other to lift up the vehicle.

In this case, it is referable that the wheel support roller of the lift bar is anti-slip surface-treated.

The invention is also directed to an object moving apparatus for moving an object with a plurality of ground points through lifting-up of said ground points, characterized by comprising:

a leader carriage comprising a carriage body travelable in all directions by travel drivers and a lifter attached to said carriage body via a link mechanism for lifting up one of the ground points of the object, said leader carriage being movable along a given target track; and a plurality of follower carriages each comprising a carriage body travelable in all directions and a lifter attached to said carriage body via a link mechanism for lifting up one of said ground points other than the ground point lifted up by said leader carriage;

wherein any of the follower carriages assumes a combination of said leader carriage with said follower carriages other than itself to be a single virtual leader carriage and estimating and follow movement of said virtual leader carriage to thereby move the object in coordination of said leader carriage and said plurality of follower carriages.

With the apparatus thus constructed, when the leader carriage moves along the given target track with the wheels or the like as ground points of the object such as the vehicle being lifted up by the lifters of the leader and respective follower carriages, each of the follower carriages assumes a combination of said leader carriage with said follower carriages other than itself to be a single virtual leader carriage and can estimate and follow the movement of the virtual leader carriage so as to move the object in coordination with the leader carriage. In the control method based upon real-time information exchange between the carriages by wireless communication, there is no fear that the object such as the vehicle may fall down and/or suffer damage due to interruption or delay of information because of communication breakdown.

Moreover, even if the object to be moved is a long wheel base vehicle such as a bus or a vehicle with a large number of wheels as ground points, it is no longer necessary to make the moving apparatus itself large-sized or to separately provide a moving apparatus with a special mechanism suitable for the large number of wheels, so that there is no need to have increased kinds of moving apparatuses. Since the moving apparatus does not require large-sized, it is unnecessary to dedicate a great deal of space for moving pathway and storage.

Advantageous Effects of Invention

Unlike the coordinated conveyance through real-time information exchange between the carriages only by wireless communication, an object moving apparatus of the invention can provide meritorious effects that an object such as a vehicle can be moved reliably and a more stable manner by coordinated control of plural carriages with no fear of the object such as the vehicle falling off and/or suffering damage.

Moreover, if a plurality of ground points of the object are supported by the separate carriages, respectively, the object moving apparatus of the invention can provide meritorious effects that, without increasing the number of kinds of apparatuses, the apparatus can cope with various objects such as vehicles with different sizes and/or with different numbers of ground points so that space needed for moving pathway and for storage can be reduced.

Figure 1:
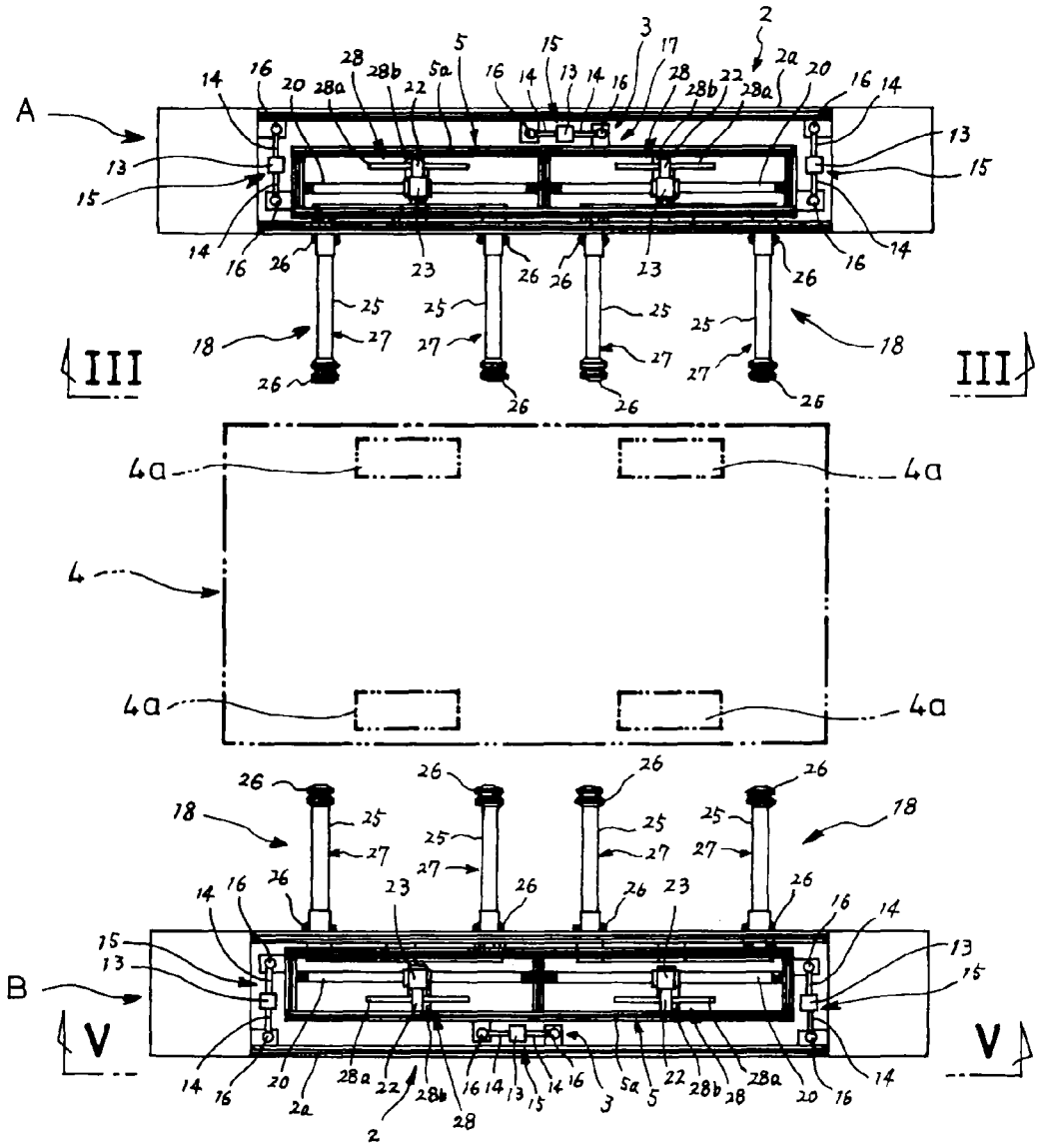
FIG. 1 is a plan view showing a first embodiment of the invention.

| Reference Signs List | |
|---|---|
| 1 | travel driver |
| 2 | carriage body |
| 2a | moving base frame |
| 3 | link mechanism |
| 4 | vehicle (object) |
| 4a | vehicle wheel (ground point) |
| 5 | lifter |
| 5a | lifter frame |
| 6 | traveling wheel |
| 7 | traveling motor (traveling actuator) |
| 9 | steering motor (traveling actuator) |
| 11 | traveling encoder (track sensor) |
| 12 | steering encoder (track sensor) |
| 13 | load cell (force sensor) |
| 14 | rod |
| 15 | link member |
| 16 | universal joint |

-continued

| Reference Signs List | |
|---|---|
| 17 | parallel linkage |
| 18 | wheel raising support |
| 19 | rack guide rail |
| 20 | drive guide rail |
| 21 | rack member |
| 22 | lift bar opening/closing sensor |
| 23 | lift bar opening/closing actuator |
| 24 | drive pinion |
| 25 | wheel support roller |
| 26 | ground support wheel |
| 27 | lift bar |
| 28 | self-aligned-position retainer |
| 28a | brake plate |
| 28b | braking electromagnetic unit |
| 29 | omni-directional mobile wheel |
| 30 | omni-wheel |
| 30a | wheel body |
| 30b | wheel axle |
| 30c | roller shaft |
| 30d | roller |
| 30e | wheel unit |
| 31 | leader control |
| 32 | follower control |
| 33 | mecanum wheel |
| 33a | wheel body |
| 33b | wheel axle |
| 33c | roller shaft |
| 33d | roller |
| 34 | displacement-detectable spring |
| 35 | displacement-detectable damper |
| 36 | spatial parallel linkage |
| 39 | wireless communication device |
| 40 | wireless communication device |
| A | leader carriage |
| A' | virtual leader carriage |
| B | follower carriage |

DESCRIPTION OF EMBODIMENT

Embodiments of the invention will be described in conjunction with the drawings.

FIGS. 1-14 show a first embodiment of an object moving apparatus according to the invention comprising:

a leader carriage A comprising a carriage body 2 travelable in all directions by travel drivers 1 and a lifter 5 attached via a link mechanism 3 to the carriage body 2 and positioned on one of lateral sides of a vehicle 4 as the object so as to lift up the vehicle 4, the leader carriage movable along a given target track; and a follower carriage B comprising a carriage body 2 travelable in all directions and a lifter 5 attached via a link mechanism 3 to the carriage body 2 and positioned on the other lateral side of the vehicle 4 so as to lift up the vehicle 4, the follower carriage estimating and following movement of the leader carriage A to thereby move the vehicle 4 in coordination with the leader carriage A.

Figure 6:
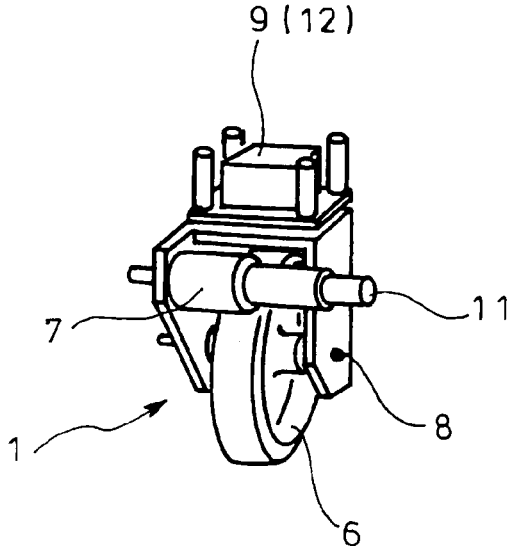
FIG. 6 is a perspective view showing a travel driver of the leader (or follower) carriage in the first embodiment of the invention.
Figure 7:
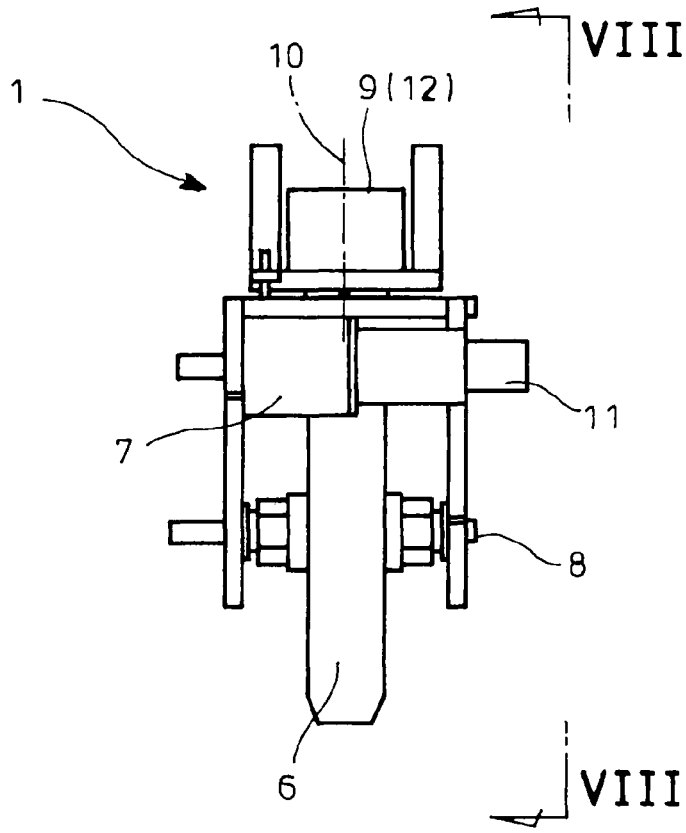
FIG. 7 is a front view showing the travel driver of the leader (or follower) carriage in the first embodiment of the invention.
Figure 8:
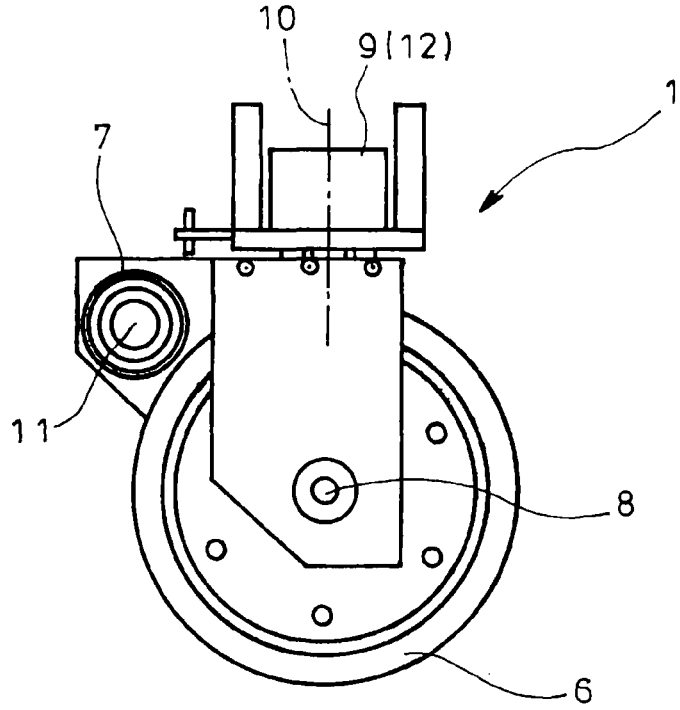
FIG. 8 is a side view showing the travel driver of the leader (or follower) carriage in the first embodiment of the invention, as seen in the direction of arrows VIII in FIG. 7.

As shown in FIGS. 1-5, the carriage body 2 comprises a moving base frame 2*a* assembled in the form of an elongated rectangular parallelepiped and a traveling wheel 6 as a travel driver 1 arranged on each of opposite ends of the base frame 2*a*. As shown in FIGS. 6-8, the traveling wheel 6 is rotatable around a horizontal axle 8 by a traveling motor 7 (a traveling actuator) and is swingable around a vertical axis 10 by a steering motor 9 (a traveling actuator). The traveling and steering motors 7 and 9 are integral with traveling and steering encoders 11 and 12 as track sensors, respectively, so as to detect actual track information on the carriage body 2.

Figure 2:
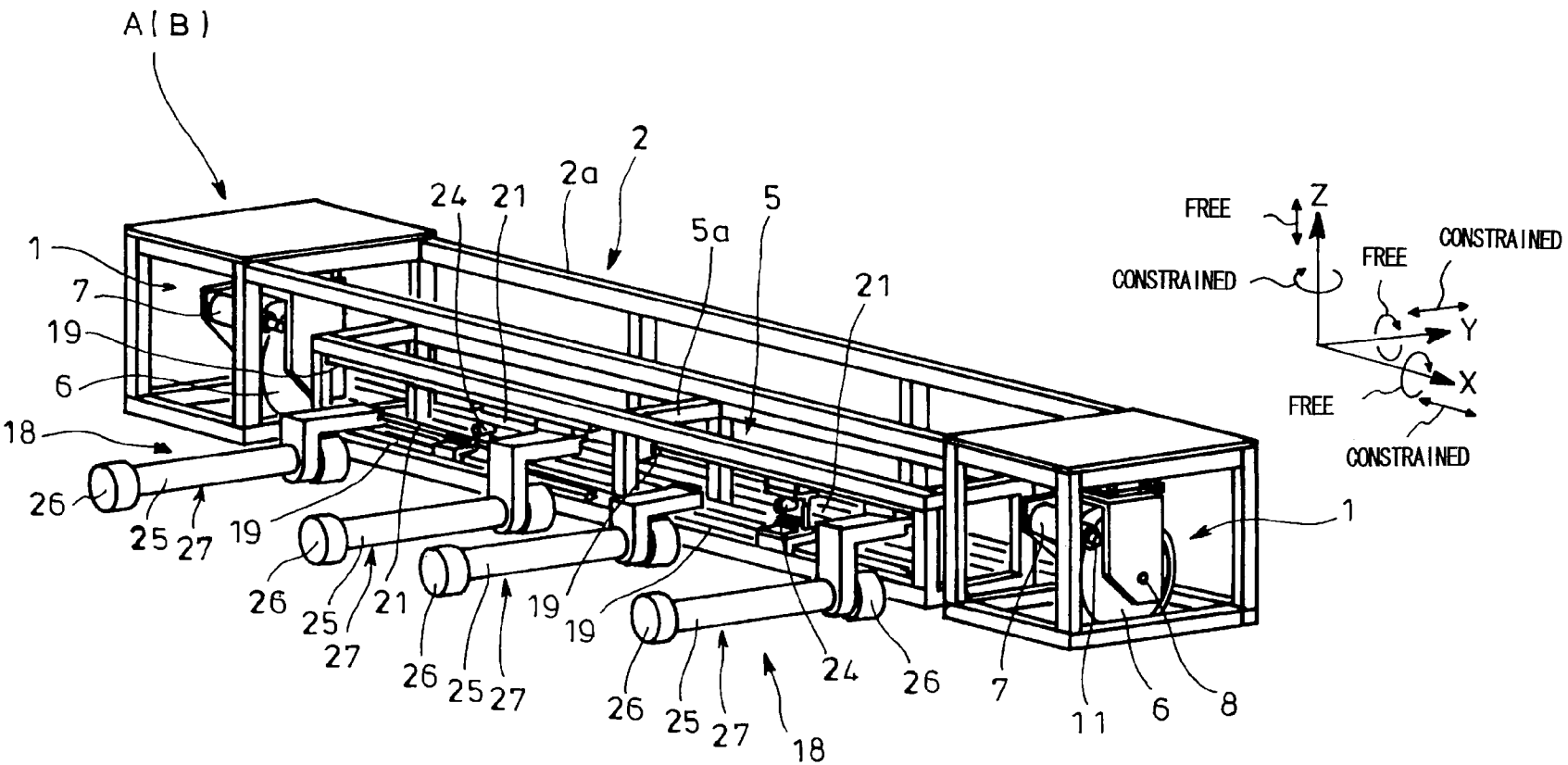
FIG. 2 is a perspective view showing a leader (or follower) carriage in the first embodiment of the invention.
Figure 3:
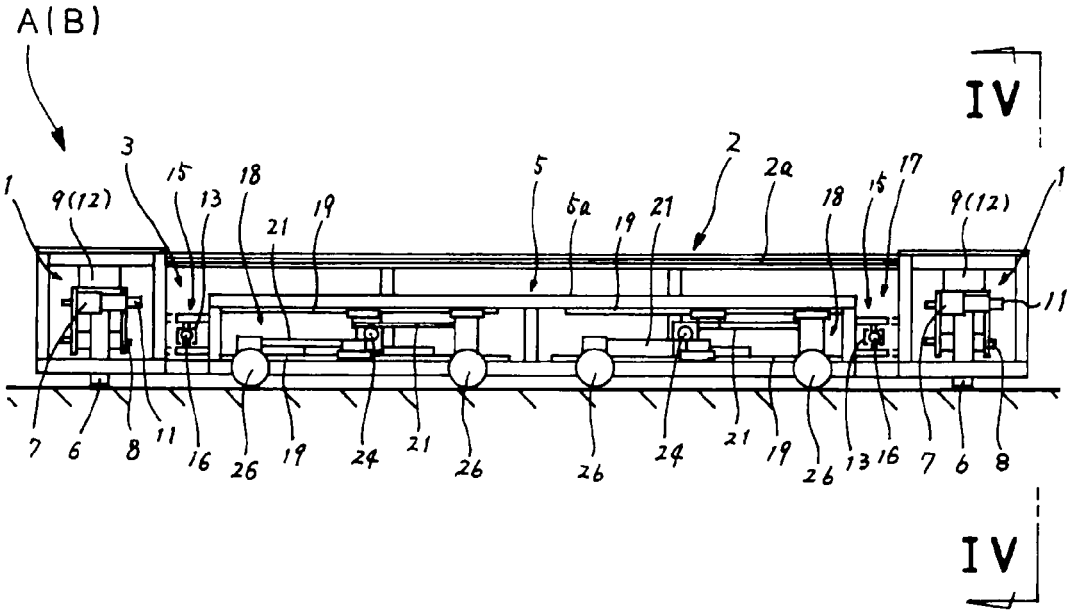
FIG. 3 is a front view showing the leader (or follower) carriage in the first embodiment of the invention, as seen in the direction of arrows III in FIG. 1.
Figure 4:
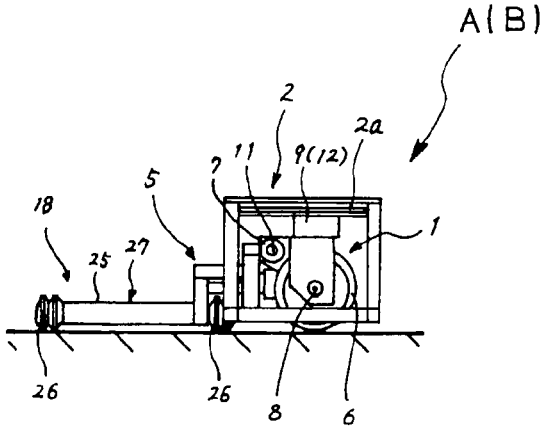
FIG. 4 is a side view showing the leader (or follower) carriage in the first embodiment of the invention, as seen in the direction of arrows IV in FIG. 3.
Figure 5:
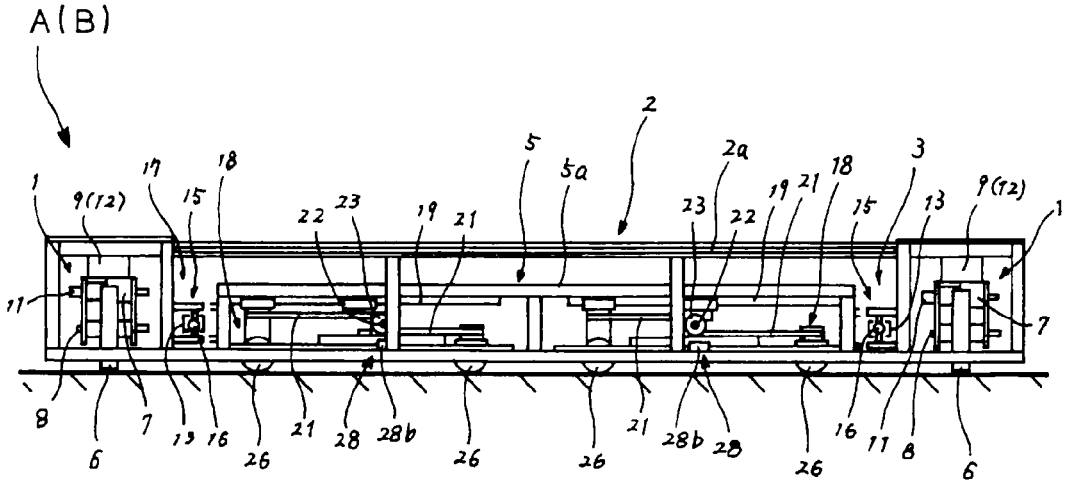
FIG. 5 is a rear view showing the leader (or follower) carriage in the first embodiment of the invention, as seen in the direction of arrows V in FIG. 1.
Figure 9:
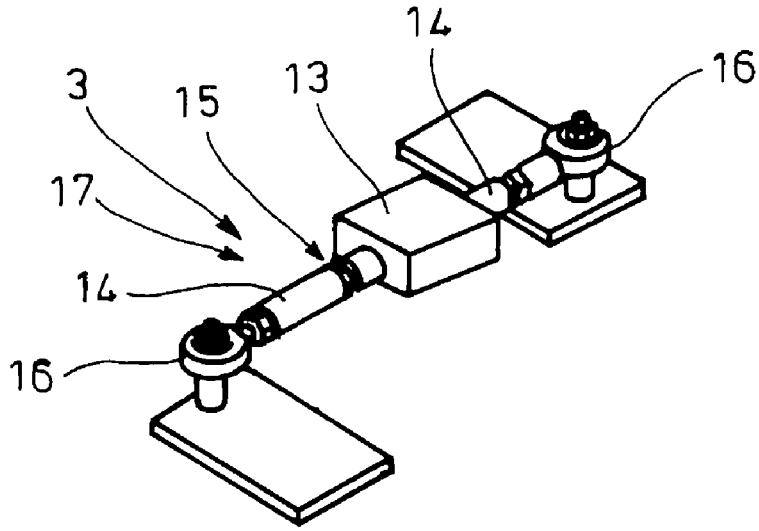
FIG. 9 is a perspective view showing a link mechanism of the leader (or follower) carriage in the first embodiment of the invention.
Figure 10:
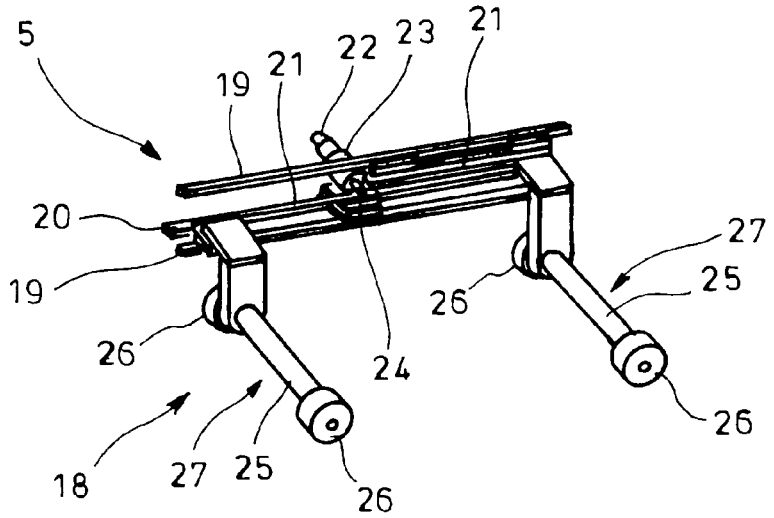
FIG. 10 is perspective views showing a wheel raising support of a lifter of the leader (or follower) carriage in the first embodiment of the invention, with FIG. 10(*a*) being a front perspective view and FIG. 10(*b*) being a rear perspective view.
Figure 10:
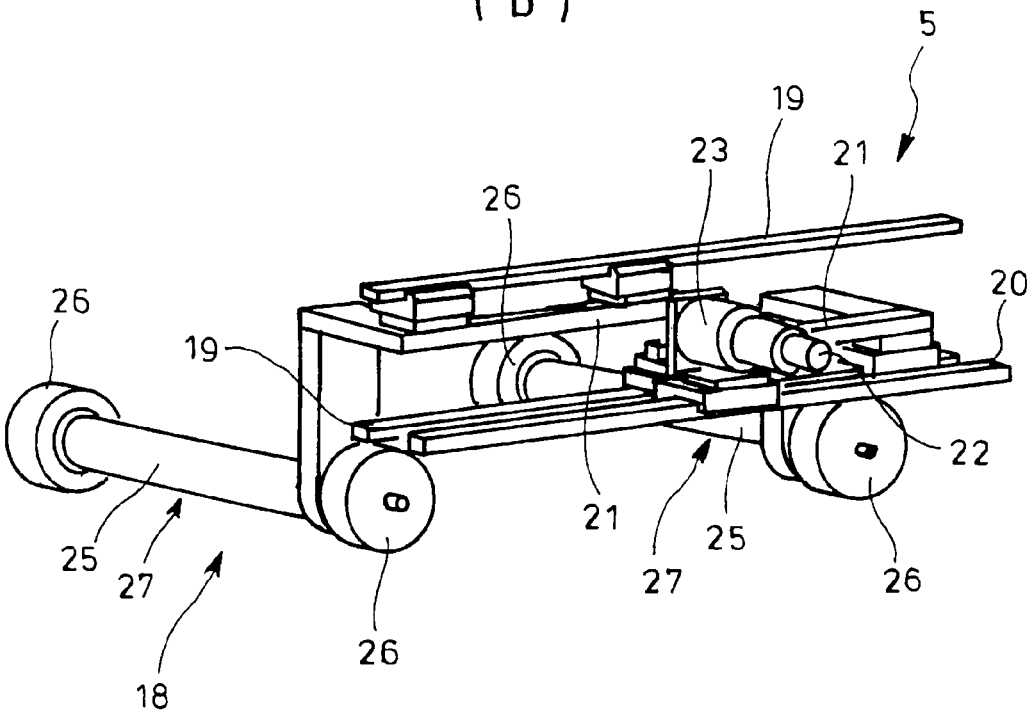

As shown in FIGS. 1 and 9, the link mechanism 3 is provided by a parallel linkage 17 comprising a plurality of (three in FIG. 1) link members 15 arranged on a single horizontal plane. Each of the link members 15 comprises a tension/compression load cell 13 as a force sensor and rods 14 attached to opposite ends of the load cell 13, respectively, and has one and the other ends connected through universal joints 16 to the carriage body 2 and the lifter 5, respectively. In this case, the lifter 5 is arranged on the carriage body 2 through the parallel linkage 17 (see FIGS. 1 and 9) such that, as shown in FIG. 2, constrained in total are three planar degrees of freedom, i.e. two degrees of freedom to move in X and Y directions in the horizontal plane and one degree of freedom in a direction to rotate around a Z-axis orthogonal to the X and Y direction while made free are three degrees of freedom in total, i.e. one degree of freedom in a direction to rotate around the X-axis, one degree of freedom in a direction to rotate around the Y-axis and one degree of freedom in a direction to move along the Z-axis.

Figure 12:
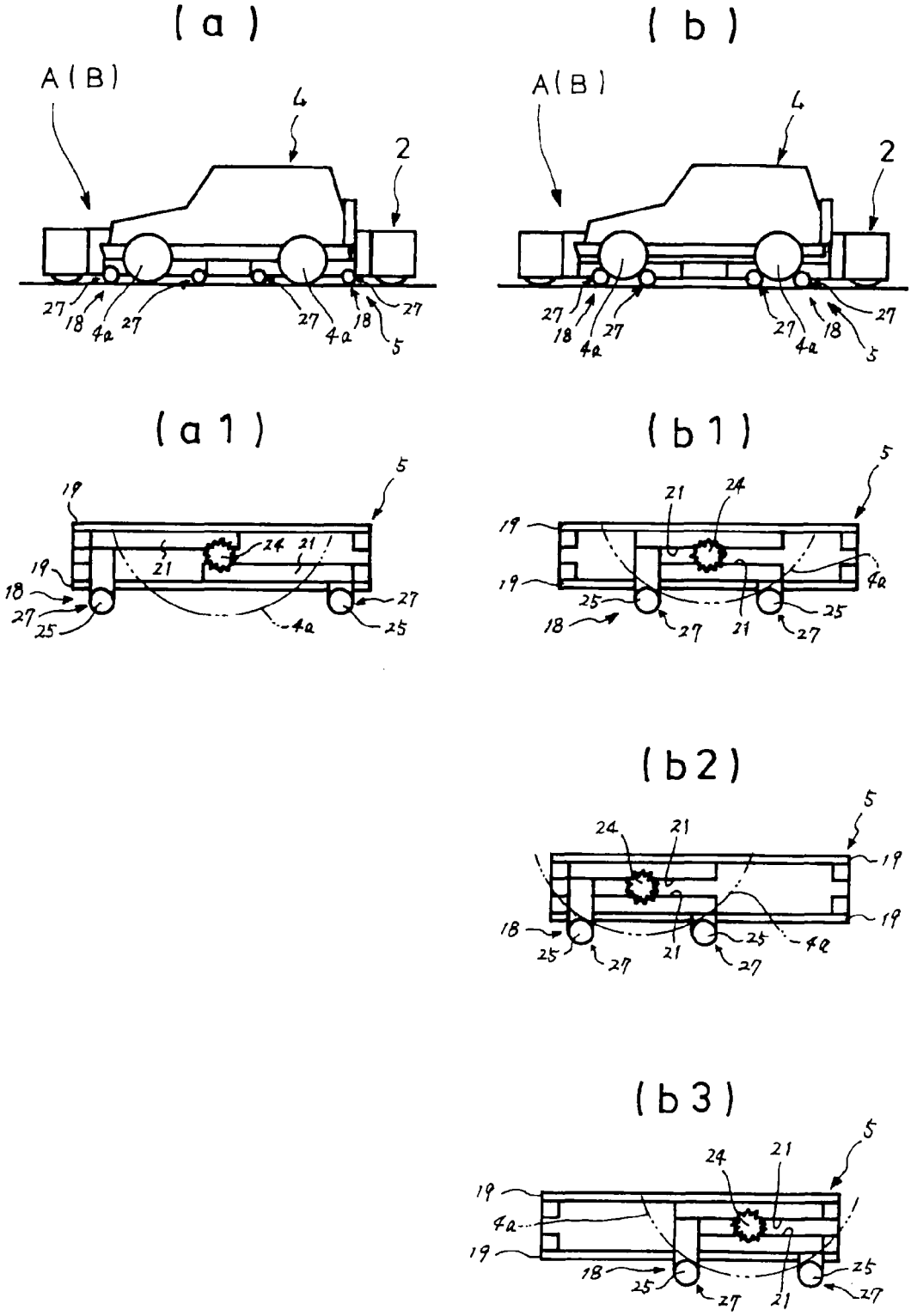
FIG. 12 is views for explanation of operational states of a wheel raising supports of the lifter in the leader (or follower) carriage in the first embodiment of the invention, with FIG. 12(*a*) showing a state before supporting a vehicle, FIG. 12(*al*) showing a state of the paired lift bars being opened to their maximum separation, FIG. 12(*b*) showing a state of the vehicle being supported, FIG. 12(*b*1) showing a state of the lift bars being closed to their minimum separation, FIG. 12(*b*2) showing a state of the lift bars being closed while biased towards the left on the sheet shown and FIG. 12(*b*3) showing a state of the lift bars being closed while biased towards the right on the sheet shown.

The lifter 5 is provided with wheel raising supports 18 each for each of wheels 4*a* of the vehicle 4 as shown in FIGS. 1-5 and 10. In a lifter frame 5*a* attached to the carriage body 2 via the link mechanism 3, each of the wheel raising supports 18 comprises a pair of rack guide rails 19 secured to extend in parallel with each other, a drive guide rail 20 secured to extend in parallel with the rack guide rails 19, a pair of rack members 21 slidably arranged along the rack guide rails 19 and having rack portions vertically confronting each other, a lift bar opening/closing actuator 23 such as a motor integral with a lift bar opening/closing sensor 22 such as an encoder slidably arranged along the drive guide rail 20, a drive pinion 24 meshed with both of the mutually confronting rack portions of the paired rack members 21 and rotatively driven by the lift bar opening/closing actuator 23, lift bars 27 each having a wheel support roller 25 rotatably fitted over the bar and ground support wheels 26 at base and tip ends of the bar and projected at one and the other ends of the one and the other rack members 21 at right angles thereto, respectively, and a self-aligned-position retainer 28 arranged for keeping the actuator 23 at a desired position on the drive guide rail 20. Thus, as shown in FIG. 12, the paired lift bars 27 of each of the wheel raising supports 18 of the lifters 5 are positioned fore and aft of the corresponding wheel 4*a* of the vehicle 4 and are adapted to be moved toward each other to lift up the vehicle 4.

The wheel support roller 25 of the lift bar 27 is anti-slip surface-treated with, for example, knurling or painting with anti-slip paint.

Figure 11:
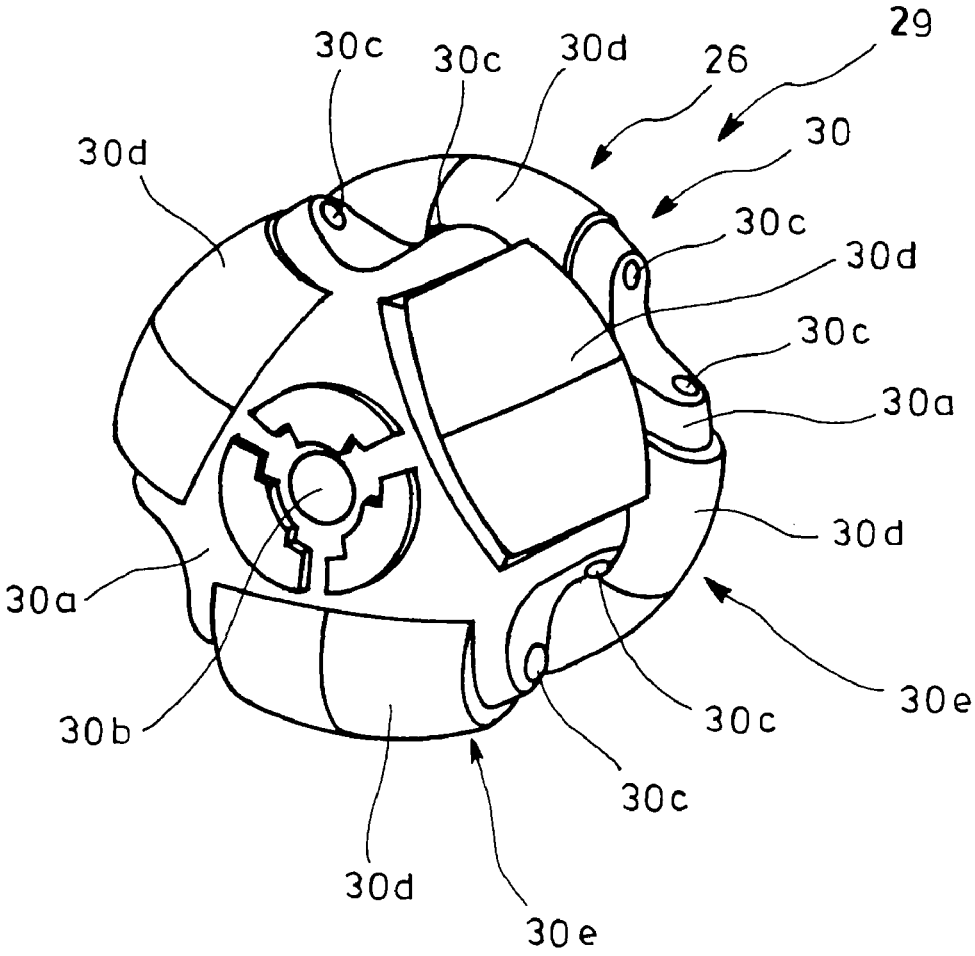
FIG. 11 is a perspective view showing an omni-wheel applicable as a ground support wheel of the wheel raising support of the lifter in the leader (or follower) carriage in the first embodiment of the invention.

As shown in FIG. 11, used as the ground support wheels 26 are omni-wheels 30 such as Omniwheel (registered trademark) as omni-directional wheels 29 movable omni-directionally without steering. Each of the omni-wheels 30 comprises a plurality of (two in FIG. 11) wheel units 30*e* provided along a wheel axle 30*b*; each of the wheel units 30*e* comprises a wheel body 30*a* circumferentially provided with a plurality of (three in FIG. 11) roller shafts 30*c* extending tangentially and perpendicular to the wheel axle 30*b* and with barrel-shaped rollers 30*d* each rotatably fitted over each of the roller shafts 30*c*. The second three of these rollers 30*d* are arranged in phase shift of 60° to the first three, so that when seen from the direction of the wheel axle 30*b*, it looks like as if the six rollers 30*d* were arranged in a circle substantially provided by outsides of the six rollers 30*d*.

Each of the self-aligned-position retainers 28 comprises, as shown in FIG. 1, a brake plate 28*a* integral with the corresponding lift bar opening/closing actuator 23 and extending in parallel with the corresponding drive guide rail 20 and an braking electromagnetic unit 28*b* secured in the lifter frame 5 and adapted to clamp the brake plate 28*a* to keep the actuator 23 in any desired position on the drive guide rail 20.

Figure 13:
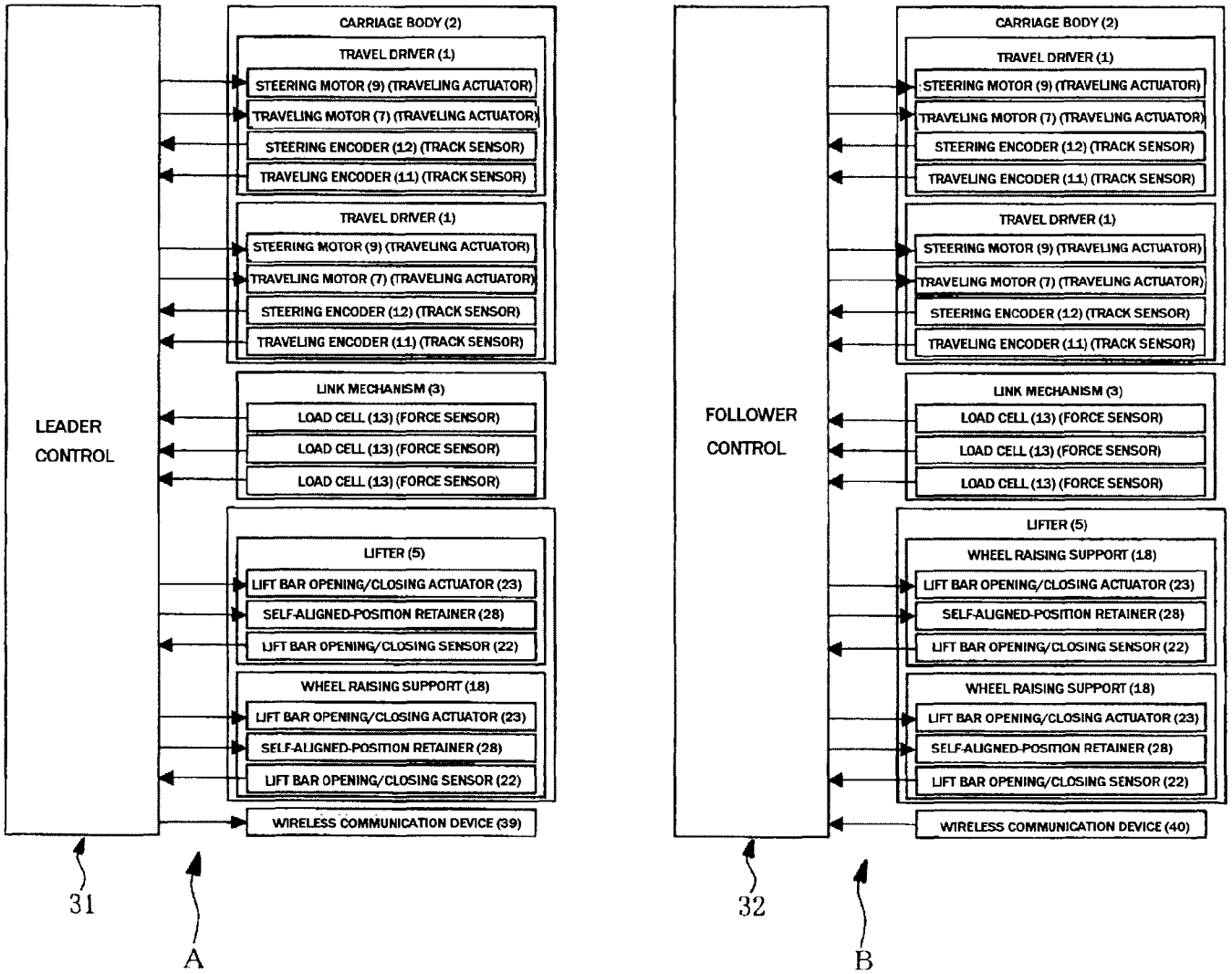
FIG. 13 is a block diagram showing overall control systems for the leader and follower carriages in the first embodiment of the invention.

FIG. 13 is a block diagram showing overall control systems of the leader and follower carriages A and B, respectively. A leader control 31 is mounted on the leader carriage A and is connected to the steering and traveling motors 9 and 7 as traveling actuators in the travel drivers 1 of the carriage body 2, to the steering and traveling encoders 12 and 11 as track sensors in the travel drivers 1 of the carriage body 2, to the load cells 13 as force sensors in the link mechanism 3, to the lift bar opening/closing actuators 23 and self-aligned-position retainers 28 in the vehicle raising supports 18 in the lifter 5, to the lift bar opening/closing sensors 22 in the vehicle raising supports 18 in the lifter 5 and to a wireless communication device 39 for transmission of control information to the follower carriage B. On the basis of detection signals by the load cells 13 as force sensors in the link mechanism 3 and by the steering and traveling encoders 12 and 11 as track sensors in the travel drivers 1 of the carriage body 2, drive signals are outputted to the steering and traveling motors 9 and 7 as traveling actuators in the travel drivers 1 of the carriage body 2; on the basis of the detection signals by the lift bar opening/closing sensors 22 in the wheel raising supports 18 in the lifter 5, drive signals are outputted to the lift bar opening/closing actuators 23 and self-aligned-position retainers 28 in the wheel raising supports 18 of the lifter 5, while the control information is transmitted by the wireless communication device 39 to the follower carriage B. On the other hand, a follower control 32 is mounted on the follower carriage B and is connected to the steering and traveling motors 9 and 7 and as traveling actuators in the travel drivers 1 of the carriage body 2, to the steering and traveling encoders 12 and 11 as track sensors in the travel drivers 1 of the carriage body 2, to the load cells 13 as force sensors in the link mechanisms 3, to the lift bar opening/closing actuators 23 and self-aligned-position retainers 28 in the vehicle raising supports 18 in the lifter 5, to the lift bar opening/closing sensors 22 in the vehicle raising supports 18 in the lifter 5 and to a wireless communication device 40 for reception of control information from the leader carriage A. On the basis of detection signals by the load cells 13 as force sensors in the link mechanism 3 and by the steering and traveling encoders 12 and 11 as track sensors in the travel drivers 1 of the carriage body 2 and on the basis of the control information received by the wireless communication device 40 from the leader carriage A, drive signals are outputted to the steering and traveling motors 9 and 7 as traveling actuators in the travel drivers 1 of the carriage body 2; on the basis of the detection signals by the lift bar opening/closing sensors 22 in the wheel raising supports 18 of the lifter 5, drive signals are outputted to the lift bar opening/closing actuators 23 and self-aligned-position retainers 28 in the wheel raising supports 18 of the lifter 5.

Figure 14:
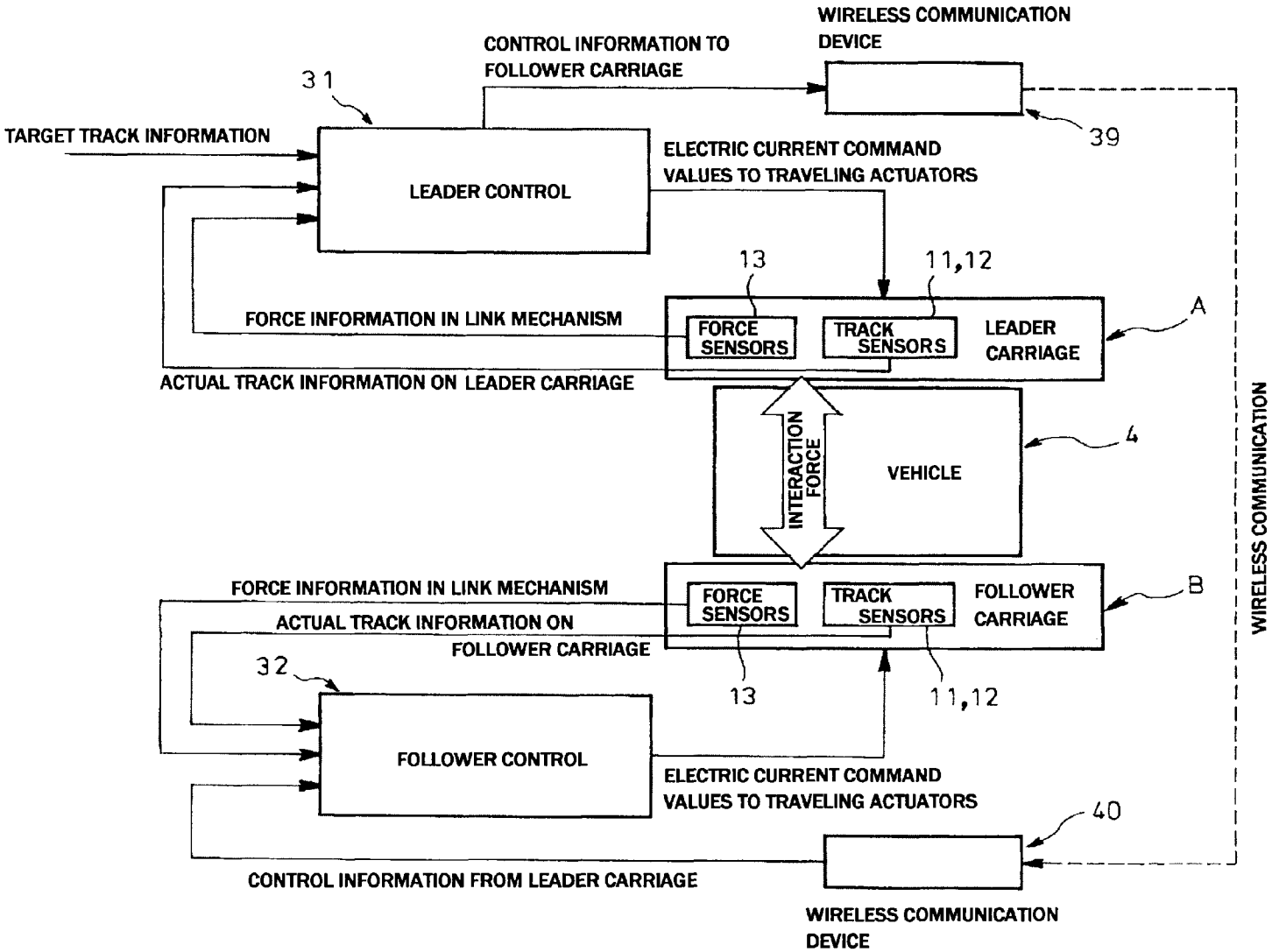
FIG. 14 is a system diagram related to coordinated control of the leader and follower carriages in the first embodiment of the invention.

The system for coordinated control of the leader and follower carriages A and B will be described more specifically. As shown in FIG. 14, the interaction force via the vehicle 4 between the leader and follower carriages A and B is detected as force information by the load cells 13 as force sensors in the leader carriage A. Actual track information of the carriage body 2 of the leader carriage A is detected by the track sensors. On the basis of the target track information inputted in advance, the force information detected by the load cells 13 as force sensors of the leader carriage A and the actual track information of the leader carriage A detected by the track sensors, the leader control 31 outputs electric current command values to the traveling actuators of the carriage body 2 of the leader carriage A and thereby causes the carriage body 2 of the leader carriage A to move along the target track while transmitting the control information to the follower carriage B by the wireless communication device 39. On the other hand, the interaction force via the vehicle 4 between the leader and follower carriages A and B is detected as force information by the load cells 13 as force sensors of the follower carriage B. Actual track information for the carriage body 2 of the follower carriage B is detected by the track sensors. The control information from the leader carriage A transmitted by the wireless communication device 39 is received by the wireless communication device 40. On the basis of the force information detected by the load cells 13 as force sensors of the follower carriage B, the actual track information for the follower carriage B detected by the track sensors and the control information from the leader carriage A received by the wireless communication device 40, the follower control 32 outputs electric current command values to the traveling actuators of the carriage body 2 of the follower carriage B and thereby causes the carriage body 2 of the follower carriage B to follow the movement of the leader carriage A. When disturbing factors such as inertial force and friction between the ground surface and the ground support wheels 26 of the lifter 5 affect the force information detected by the load cells 13, such disturbing factors may undesirably increase errors in the movement of the follower carriage B attempting to follow the movement of the leader carriage A. Thus, in order to move the vehicle 4 in a more stable state in coordination of the leader and follower carriages A and B, the control information for compensating such errors becomes necessary which is transmitted by the leader control 31 via the wireless communication device 39 of the leader carriage A to the wireless communication device 40 of the follower carriage B, so that calculation for compensation of the errors is performed by the follower control 32 on the basis of the control information.

When the three link members 15 each with the tension/compression load cell 13 as the force sensor being interposed are arranged as the parallel linkage 17 with constrain of three planar degrees of freedom as shown in FIG. 1, values detected by the load cells 13 may be coordinate-converted with a Jacobian matrix to obtain forces exerted as external forces on the lifter 5 as force information for the three planar degrees of freedom.

Figure 15:
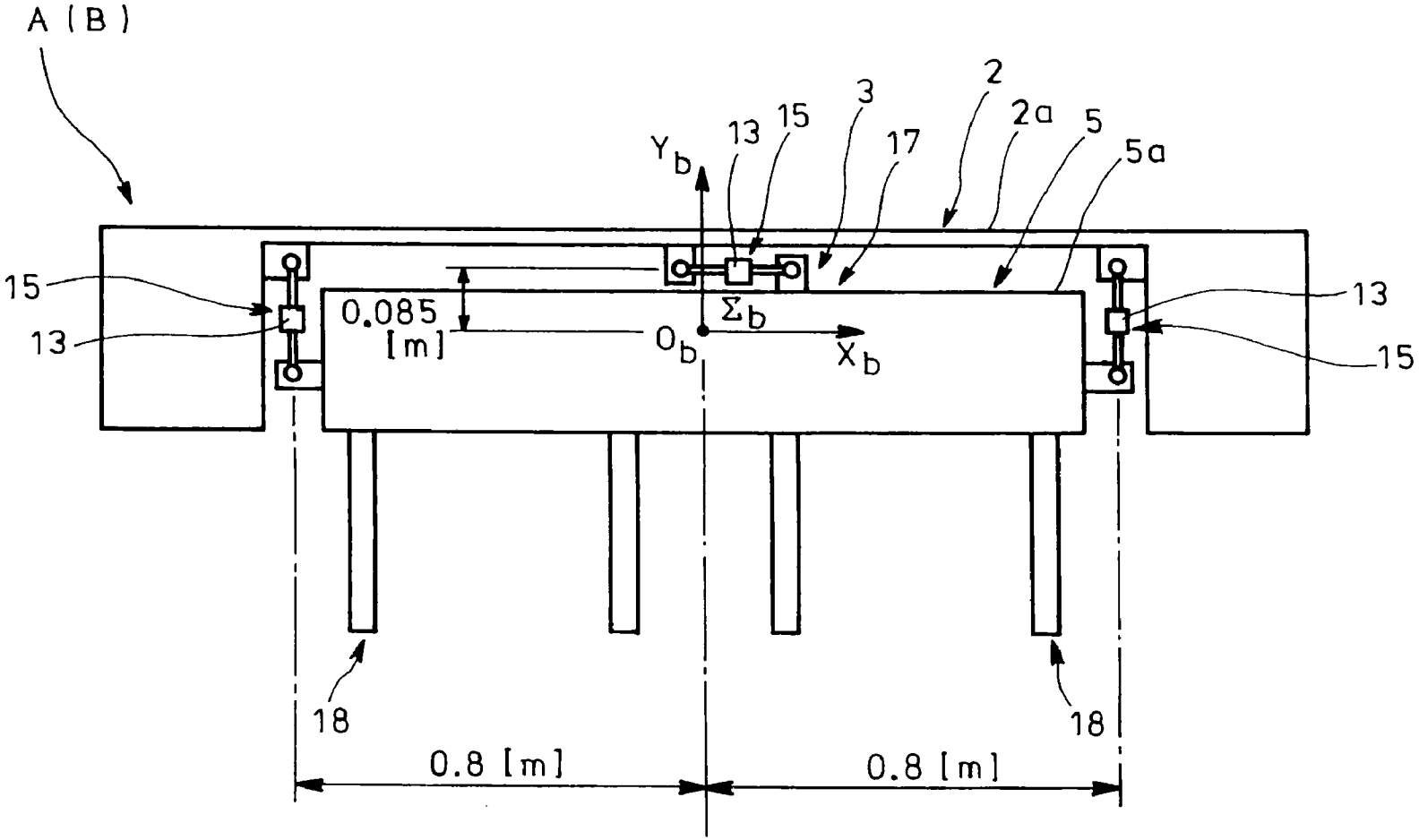
FIG. 15 is a plan view showing a coordinate system used when calculating a force vector applied to the lifter in the first embodiment of the invention.

Specifically, if $O_b$ is taken as the origin and a coordinate system $\Sigma_b$ with axes $X_b$-$Y_b$ is assumed as shown in FIG. 15, then force vector F acting on the lifter 5 is given by $$F = \begin{bmatrix} x \\ y \\ \theta \end{bmatrix} = J_I^T \cdot f_s \qquad \text{[Equation 1]}$$

where x: force applied in the direction of X-axis y: force applied in the direction of Y-axis θ: torque applied about the origin $O_b$ $J_I^T$: transposed matrix of Jacobian inverse matrix for the parallel linkage 17 and $f_s$: information on force applied to the link members 15

The origin $O_b$, which may be set at any desired position, is set at the central plane of the leader carriage A (or the follower carriage B) in the example shown in FIG. 15 for the sake of easy calculation.

Since the transposed matrix $J_I^T$ of the Jacobian inverse matrix for the parallel linkage 17 and the information $f_s$ on the force applied to the link members 15 are respectively given by:

$$J_l^T = \begin{bmatrix} a_{11} & a_{12} & a_{13} \\ a_{21} & a_{22} & a_{23} \\ a_{31} & a_{32} & a_{33} \end{bmatrix} \quad \text{[Equation 2]}$$

$$f_s = \begin{bmatrix} f_1 \\ f_2 \\ f_3 \end{bmatrix}$$

Therefore, according to Equations 1 and 2, $$\begin{bmatrix} x \\ y \\ \theta \end{bmatrix} = \begin{bmatrix} a_{11} & a_{12} & a_{13} \\ a_{21} & a_{22} & a_{23} \\ a_{31} & a_{32} & a_{33} \end{bmatrix} \begin{bmatrix} f_1 \\ f_2 \\ f_3 \end{bmatrix} \quad \text{[Equation 3]}$$

In this connection, in the example shown in FIG. 15, the transposed matrix $J_l^T$ of the Jacobian inverse matrix for the parallel linkage 17 is given by:

$$J_l^T = \begin{bmatrix} 0 & 1 & 0 \\ -1 & 0 & -1 \\ 0.8 & 0.085 & -0.8 \end{bmatrix} \quad \text{[Equation 4]}$$

And therefore:

$$\begin{aligned} X &= a_{11} \cdot f_1 + a_{12} \cdot f_2 + a_{13} \cdot f_3 \\ &= f_2 \\ y &= a_{21} \cdot f_1 + a_{22} \cdot f_2 + a_{23} \cdot f_3 \\ &= -f_1 - f_3 \\ \theta &= a_{31} \cdot f_1 + a_{32} \cdot f_2 + a_{33} \cdot f_3 \\ &= 0.8f_1 + 0.085f_2 - 0.8f_3 \end{aligned} \quad \text{[Equation 5]}$$

Thus, the respective values of Equation 5 are calculated from the values detected by the load cells 13. The steering angles and the rotational speeds of the traveling wheels 6 of the travel drivers 1 of the carriage bodies 2 are determined on the basis of the calculated values of Equation 5, so that drive signals can be outputted to the steering and traveling motors 9 and 7 as traveling actuators so as to bring a sum of the force vectors F imposed on the lifters 5 of the leader and follower carriages A and B to fundamentally zero, whereby the vehicle 4 can be moved while performing coordinated control of the leader and follower carriages A and B.

A basic concept on coordinated control of the leader and follower carriages A and B is disclosed in "Decentralized Control of Multiple Mobile Robots Handling a Single Object in Coordination", Journal of The Robotics Society of Japan, vol. 16, No. 1, pp. 87-95, by Kazuhiro Kosuge, Tomohiro Oosumi and Kunihiko Chiba.

Next, mode of operation of the first embodiment will be described.

First, with the vehicle 4 stopped, the leader carriage A is caused to travel to one of lateral sides of the vehicle to bring the lift bars 27 of the wheel raising supports 18 of its lifter 5 to be positioned fore and aft of one and the other wheels (front and rear wheels) 4*a* of the vehicle 4 at this side, respectively. The follower carriage B is caused to travel to the other lateral side of the vehicle 4 to bring the lift bars 27 of the wheel raising support 18 of its lifter 5 to be positioned fore and aft of one and the other wheels (front and rear wheels) 4*a* of the vehicle at this side, respectively.

Then, with the self-aligned-position retainers 28 being released, the lift bar opening/closing actuators 23 of the wheel raising supports 18 of the lifters 5 are rotationally driven in desired directions according to the drive signals from the leader and follower controls 31 and 32 to move the respective paired lift bars 27 from the state shown in FIGS. 12(*a*) and 12(*a*1) toward each other, so that, as shown in FIGS. 12(*b*) and 12(*b*1), the wheels 4*a* of the vehicle 4 are caused to rest on the lift bars 27, whereby the vehicle 4 is lifted up.

In this connection, the lift bar opening/closing actuator 23 is arranged slidably along the guide rail 20, so that, when the lift bar 27 located fore of the vehicle 4 (on the left in FIG. 12) in the fore-and-aft directions first comes into contact with the wheel 4*a* as shown in FIG. 12(*b*2) during the movement of the paired lift bars 27 toward each other, the other lift bar located aft of the vehicle (on the right in FIG. 12) will move forward; and conversely, when the lift bar 27 located aft of the vehicle 4 in the fore-and-aft directions first comes into contact with the wheel 4*a* as shown in FIG. 12(*b*3), the other lift bar located fore of the vehicle 4 will move backward. Thus, without affected by a wheelbase of the vehicle 4, the lift bar opening/closing actuators 23 are self-aligned into positions centrally of the wheels 4*a* in the fore-and-aft directions. After the vehicle 4 is lifted up, the brake plates 28*a* integral with the lift bar opening/closing actuators 23 and extending in parallel with the drive guide rails 20, respectively, are clamped by the braking electromagnetic units 28*b* of the self-aligned-position retainers 28 fixed within the lifter frames 5*a* so that the opening/closing actuators 23 are kept at the desired positions on the drive guide rails 20 and the lift bars 27 are locked.

As shown in FIG. 14, with the target track information being inputted in advance to the leader control 31 of the leader carriage A, the electrical current command values are outputted to the steering and traveling motors 9 and 7 as traveling actuators of the carriage body of the leader carriage A to move the carriage body 2 of the leader carriage A along the target track while the control information is transmitted by the wireless communication device 39 of the leader carriage A to the follower carriage B. Simultaneously with this, the interaction force between the leader and follower carriages A and B via the vehicle 4 is detected as force information by the load cells 13 as force sensors of the follower carriage B, the actual track information on the carriage body 2 of the follower carriage B is detected by its steering and traveling encoders 12 and 11 as track sensors and the control information transmitted from the leader carriage A by its wireless communication device 39 is received by the wireless communication device 40. On the basis of the force information detected by the load cells 13 as force sensors of the follower carriage B, the actual track information detected by the steering and traveling encoders 12 and 11 as track sensors of the follower carriage B and the control information from the leader carriage A received by the wireless communication device 40, electrical current command values are outputted by the follower control 32 to the traveling actuators of the carriage body 2 of the follower carriage B, so that the carriage body 2 of the follower carriage B follows the movement of the leader carriage A. Thus, even if some disturbing factors such as inertial force and friction between the ground surface and the ground support wheels 26 of the lifter 5 affect the force information detected by the load cells 13 for following of the carriage body 2 of the follower carriage B to the movement of the leader carriage A, control information necessary for compensating such errors in the movement of the follower carriage B attempting to follow the movement of the leader carriage A is transmitted by the leader control 31 via the wireless communication device 39 of the leader carriage A to the wireless communication device 40 of the follower carriage B, and the calculation for compensation of the errors is performed by the follower control 32 on the basis of the control information, so that the vehicle 4 can be moved in coordination of the leader and follower carriages A and B in a more stabilized state.

When the leader and follower carriages A and B reach the target point, then in a manner converse to the operation described above, the self-aligned-position retainers 28 are released, the paired lift bars 27 are driven in the directions away from each other to lower down the vehicle 4 having rested on the lift bars 27 on a destination point and then the leader and follower carriages A and B are retracted laterally away from the vehicle 4.

Thus, when the leader carriage A is moved along the target track with the vehicle 4 been lifted up by the lifters 5 of the leader and follower carriages A and B, the follower carriage B can estimate and follow the movement of the leader carriage A to thereby move the vehicle 4 in coordination with the leader carriage A. In the control method based upon real-time information exchange between the carriages by wireless communication, there is no fear that the object such as the vehicle may fall down and/or suffer damage due to interruption or delay of information because of communication breakdown.

During coordinated conveyance of the vehicle 4 supported between the leader and follower carriages A and B, if the vehicle 4 weighs not so much, there is a danger that the wheels 4*a* of the vehicle 4 might slip on the wheel support rollers 25 of the lift bars 27, resulting in an obstacle to the coordinated conveyance procedure; however, since the surfaces of the wheel support rollers 25 of the lift bars 27 are subjected to anti-slip processing by knurling or painting with anti-slip paint and the wheels 4*a* of the vehicle 4 on the wheel support rollers 25 of the lift bars 27 are prevented from slipping even if the vehicle 4 is light-weight, so that there is no fear that any obstacle to the coordinated conveyance procedure may arise.

Thus, unlike the coordinate conveyance with real-time information exchange only by wireless communication, without fear that the vehicle 4 may fall down and/or suffer damage, the vehicle 4 can be reliably and more stably moved by performing coordinated control of the plural carriages.

Figure 16:
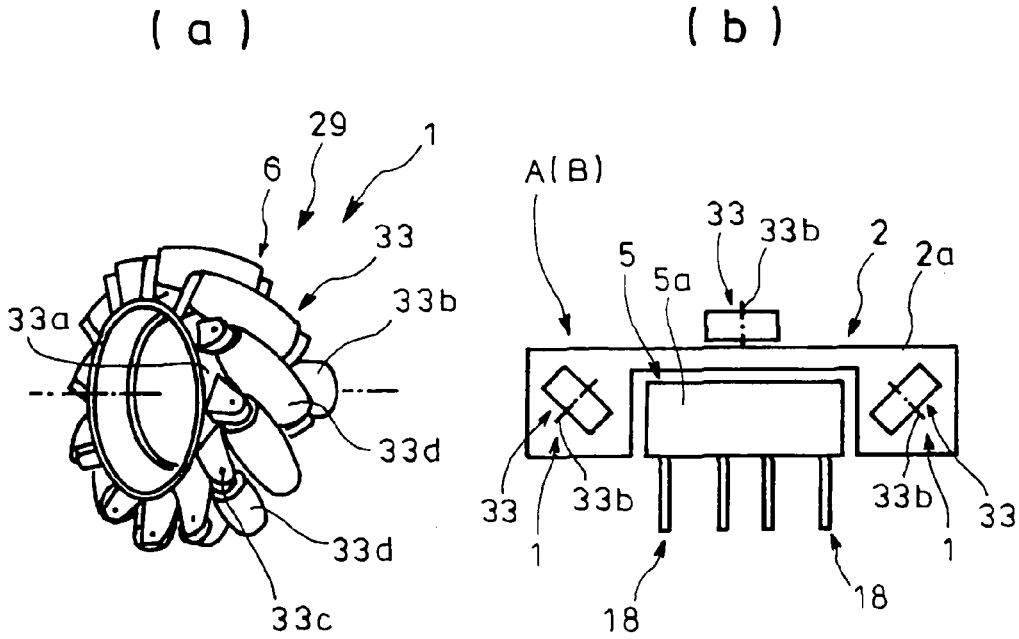
FIG. 16 is views showing a modification of a travel driver for the first embodiment of the invention, with FIG. 16(*a*) being a perspective view showing a mecanum wheel as an omni-directional mobile wheel, and FIG. 16(*b*) being a plan view showing an example of an arrangement of the mecanum wheels.

FIG. 16 shows a modification of the travel drivers 1 in which the traveling wheels 6 of the carriage body 2 are omni-directional mobile wheels 29 requiring no steering. As shown in FIG. 16(*a*), each of the omni-directional mobile wheels 29 is provided by a mecanum wheel comprising a wheel body 33*a* circumferentially provided with a plurality of roller shafts 33*c* tilted at 45° with respect to a wheel axle 33*b* and with rollers 33*d* each rotatably fitted over each of the roller shafts 33*c*. As shown in FIG. 16(*b*), at opposite ends and at an intermediate portion of the moving base frame 2*a* of the carriage body 2, totally three of the mecanum wheels 33 are arranged.

In the example shown in FIG. 16(*b*), the two mecanum wheels 33 at the opposite ends of the moving base frame 2*a* of the carriage body 2 are arranged with their wheel axles 33*b* extending horizontally with phase shift of 90° to each other and angled at 45° with respect to the longitudinal direction of the carriage body 2. The single mecanum wheel 33 at the intermediate portion of the moving base frame 2*a* of the carriage body 2 has the wheel axle 33*b* which extends horizontally and is angled at 90° with respect to the longitudinal direction of the carriage body 2.

With this structure, appropriate adjustment of balance in rotation between the three mecanum wheels 33 makes it possible to move the carriage body 2 in any desired direction and to orient the lifter 5 in any desired direction.

In comparison with the steering and traveling motors 9 and 7 being used as traveling actuators (see the example of FIGS. 1-8) where two each, i.e. total four motors are required for one carriage body 2, the modification of FIG. 16 is advantageous in that three motors will suffice as traveling actuators.

In place of such mecanum wheels 33, the omni-directional mobile wheels 29 may be also provided by the omni-wheels 30 as shown in FIG. 1 each comprising a plurality of wheel units 30*e* provided along a wheel axle 30*b*, each of the wheel units comprising a wheel body 30*a* circumferentially provided with a plurality of roller shafts 30*c* extending tangentially and perpendicular to the wheel axle 30*b* and with barrel-shaped rollers 30*d* each rotatably fitted over each of the roller shafts 30*c*.

Figure 17:
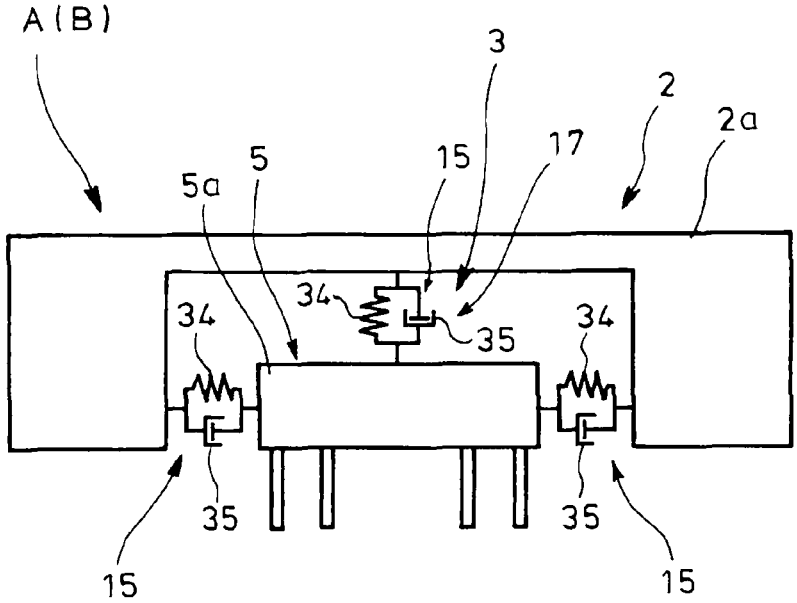
FIG. 17 is a plan view showing a modification of the link mechanism.

Each of the link members 15 for the parallel linkage 17 providing the link mechanism 3 may alternatively comprise, as shown in FIG. 17, a displacement-detectable spring 34 and a displacement-detectable damper 35. Displacements of the members are detected; and information on forces exerted on the lifters 5 is calculated on the basis of spring constants obtained and viscous coefficients of the dampers 35, so that coordinated control of the leader and follower carriages A and B can be performed. Usable as the displacement-detectable spring 34 is, for example, a spring with a distance measurement beam sensor at its one end and a reflecting plate at its other end so as to measure the displacement. In a similar manner, usable as the displacement-detectable damper 35 is, for example, a damper with a distance measurement beam sensor at its one end and a reflecting plate at its other end so as to measure the displacement.

The construction as shown in FIG. 17 is much effective for preventing undesirable deformation and/or damage from taking place on the leader and follower carriages A and B and the vehicle 4 when forces (internal forces or stresses) are generated on the carriages A and B and the vehicle 4 that are greater than strengths of the respective parts.

In the example shown in FIG. 17, each of the link members 15 of the parallel linkage 17 is constituted by both the displacement-detectable spring 34 and the displacement-detectable damper 35. Alternatively, the link member may be constituted by only the displacement-detectable spring 34 or only by the displacement-detectable damper 35.

Figure 18:
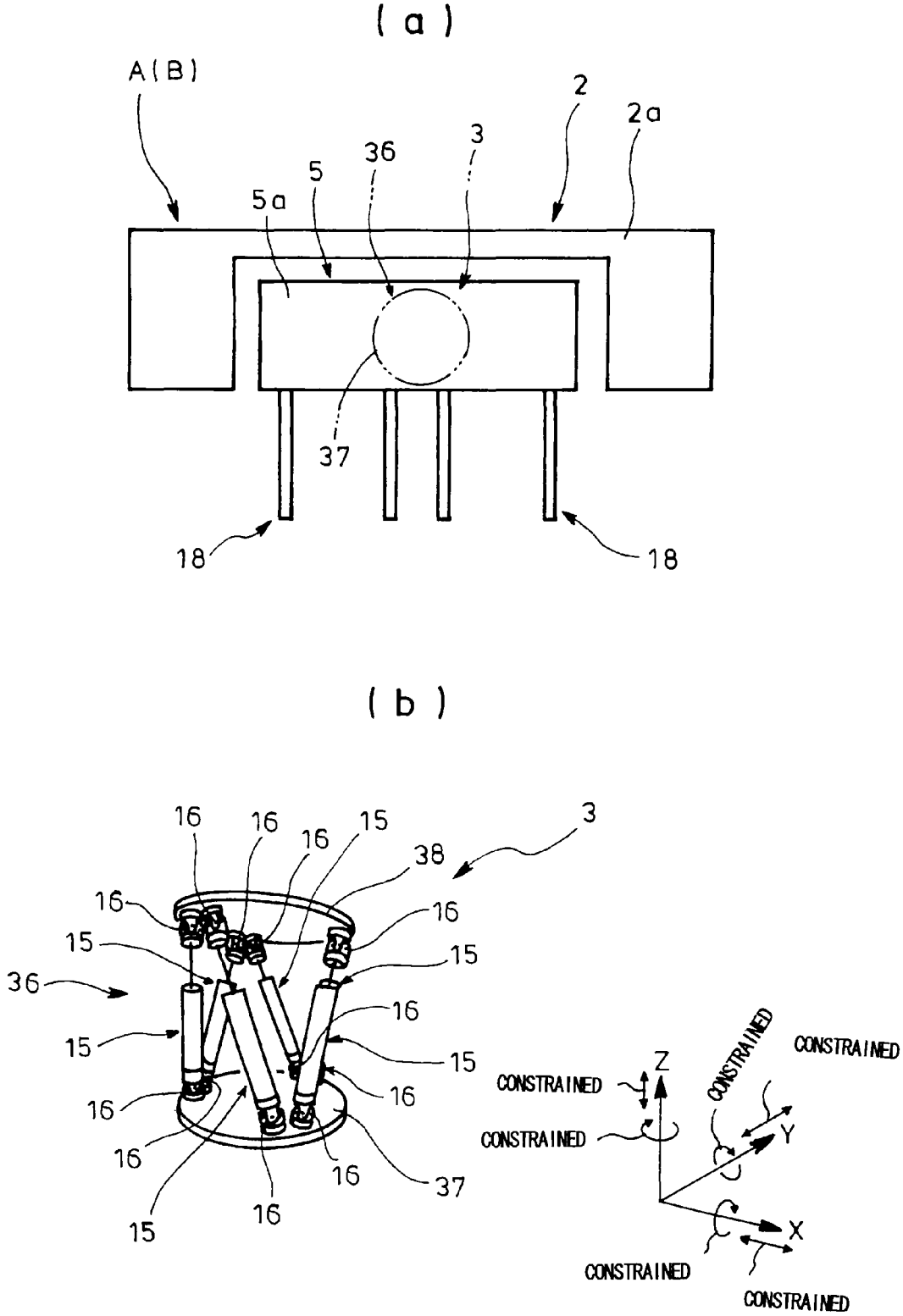
FIG. 18 is views showing a further modification of the link mechanism, with FIG. 18(*a*) being a plan view showing the arrangement, and FIG. 18(*b*) being a perspective view.

As shown in FIGS. 18(*a*) and 18(*b*), the link mechanism 3 may be alternatively provided by a spatial parallel linkage 36 comprising a plurality of spatially arranged link members 15 each serving as force sensor (six displacement-detectable dampers in the example of FIG. 18) and each with one end linked on the side of the carriage body 2 by a universal joint 16 and the other end linked on the side of the lifter 5 by a universal joint 16. Thus, to the carriage body 2 via the spatial parallel linkage 36, the lifter 5 is constrained totally in six degrees of freedom: i.e. two degrees of freedom to move in X-Y directions in the horizontal plane, one degree of freedom to rotate about a Z-axis orthogonal to the X and Y directions, one degree of freedom to rotate about the X-axis, one degree of freedom to rotate about the Y-axis and one degree of freedom to move along the Z-axis.

In the spatial parallel linkage 36, a lower base plate 37 as shown in FIG. 18(*b*) is secured to an upper surface of the lifter 5 at a central portion thereof as shown in FIG. 18(*a*) and an upper base plate 38 is secured to a lower surface of the moving base frame 2 in a corresponding position, the six rink members 15 in the form of the displacement-detectable dampers being interposed between the upper and lower base plates 38 and 37.

When the linkage is constructed as shown in FIGS. 18(*a*) and 18(*b*) and the space is expressed in terms of the X-Y-Z coordinates, the six link members 15 in the form of the displacement-detectable dampers can derive forces in the directions of the respective axes and moments around the axes. As a result, while influences due to undulations of the ground surface and the like is absorbed to alleviate disturbances caused thereby, coordinated control of the leader and follower carriages A and B can be performed more stably.

In the example shown in FIG. 18, the link members 15 for the spatial parallel linkage 36 are provided only by the displacement-detectable dampers; alternatively, the link members 15 may be provided only by displacement-detectable springs or may be provided by both the displacement-detectable springs and dampers.

Figure 19:
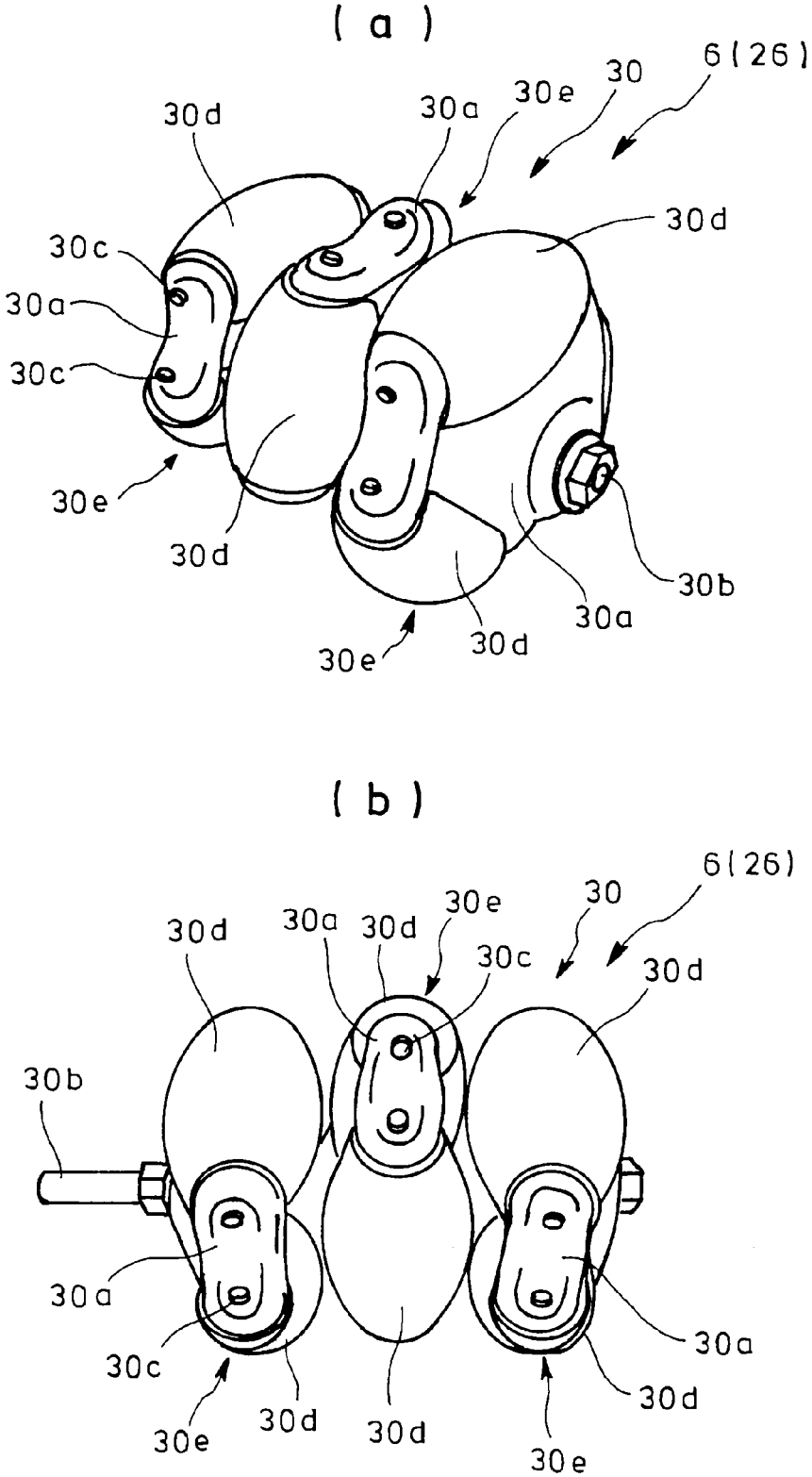
FIG. 19 is views showing three omni-wheels arranged in sequence along an wheel axle, with FIG. 19(*a*) being a perspective view, and FIG. 19(*b*) being a side view.

When the ground support wheels 26 of the lifter 5 and/or the traveling wheels 6 of the carriage body 2 are provided by omni-wheels 30 (see FIG. 11) as omni-directional wheels 29 requiring no steering, vibrations will occur due to the structure of the omni-wheels 30 during rotation thereof about the wheel axles 30 since the respective three rollers 30*d* for each of two wheel units 30*e* in sequence constituting the omni-wheel come alternately in contact with the ground surface. Such vibrations during the rotation of the omni-wheels may be suppressed by constituting, as shown in FIG. 19, each of the omni-wheel by a plurality of (three in FIG. 19) wheel units 30*e* arranged in sequence along a wheel axle 30*b* each comprising a wheel body 30*a* circumferentially provided with a plurality of (three in FIG. 19) roller shafts 30*c* extending tangentially and perpendicular to the wheel axle 30*b* and with the barrel-shaped rollers 30*d* each rotatably fitted over each of the roller shafts 30*c*. As a result, the force control can be performed more stably since adverse effects in the form of noises on the force sensors by vibrations is suppressed.

In this connection, when the omni-wheel is provided by the three wheel units 30*e* arranged in sequence along the wheel axle 30*b* and contacts the ground at opposite two of them, resistance during rotation about the wheel axle 30*b* becomes greater than when only two wheel units 30*e* are provided in sequence along the wheel axle 30*b*. However, this situation may be considered to be equivalent to steering with tire surfaces in surface contact with the ground; accordingly it will suffice to provide power sources enhanced, in consideration of friction resistance increased, for supply of power to the traveling actuators of the travel drivers 1.

It also goes without saying that not only Omniwheels (registered trademark) and mecanum wheels but also various types of wheels may be employed. For example, usable are wheels of a type in which rotating members with flexible rotation axes are arranged on an outer circumference of a wheel body in such a manner that each of the rotating members are rotatably supported at its opposite ends by adjacent support members as shown in JP 2006-16859A and in Japanese Utility Model Registration 3,130,323 or special wheels with free rollers described in Development of an Omni-Directional and Step-Climbing Mobile Robot, Abstracts of the 17th Annual Conference of the Robotics Society of Japan, pp. 913-914, September 1999, by Tatsuya Kanazawa, Atsushi Yamashita, Hajime Asama, Hayato Kaetsu, Isao Endo, Tamio Arai and Kazumi Sato.

FIGS. 20-28 show a second embodiment of the invention directed to an object moving apparatus comprising:

a leader carriage A comprising a carriage body 2 travelable in all directions by travel drivers 1 and a lifter 5 attached via a link mechanism 3 to the carriage body 2 so as to lift up one wheel 4*a* (a ground point) of a vehicle 4 as an object, the leader carriage movable along a given target track; and a plurality of (three in the example shown) follower carriages B each comprising a carriage body 2 travelable in all directions and a lifter 5 attached via a link mechanism 3 to the carriage body 2 so as to lift up one wheel 4*a* (a ground point) of the vehicle 4 other than the wheel 4*a* lifted up by the leader carriage A;

and wherein each of the follower carriages B assumes a combination of said leader carriage A and the follower carriages B other than itself to be a single virtual leader carriage A' (see FIG. 28) and estimates and follows movement of the virtual leader carriage A' so as to move the vehicle 4 in coordination of the leader carriage A and the follower carriages B.

Each of the carriage bodies 2 is similar in construction to the carriage bodies 2 in the first embodiment shown in FIGS. 1-14 and comprises, as shown in FIGS. 20-24, a moving base frame 2*a* assembled in the form of an elongated rectangular parallelepiped and a traveling wheel 6 as a travel driver 1 arranged on each of opposite ends of the carriage frame 2*a*. As shown in FIGS. 6-8, the traveling wheel 6 is rotatable around a horizontal axle 8 by a traveling motor 7 (a traveling actuator) and is swingable around a vertical axis 10 by a steering motor 9 (a traveling actuator). The traveling and steering motors 7 and 9 are integral with the traveling and steering encoders 11 and 12 as track sensors, respectively, so as to detect actual track information on the carriage body 2.

Figure 20:
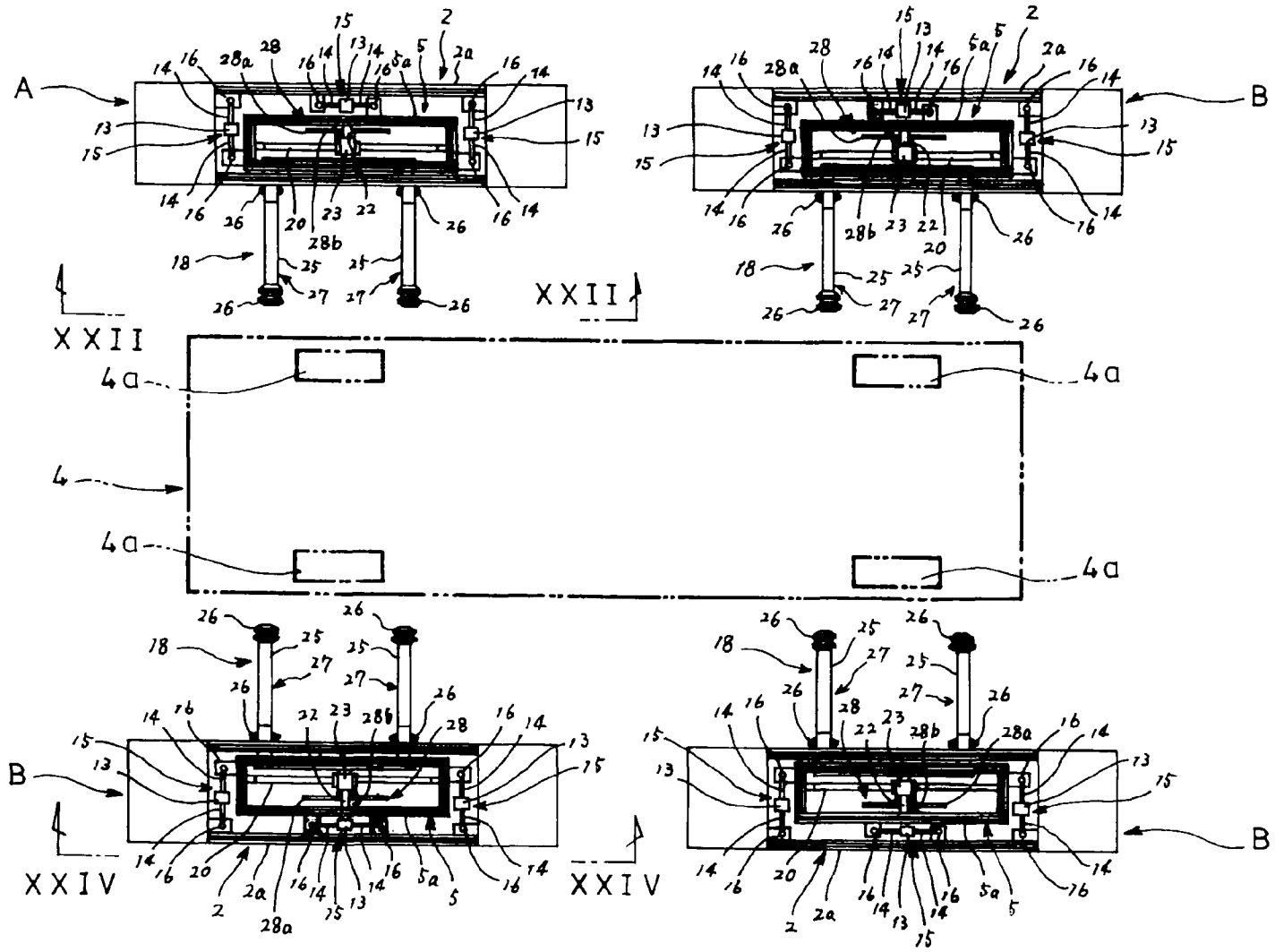
FIG. 20 is a plan view showing a second embodiment of the invention.
Figure 21:
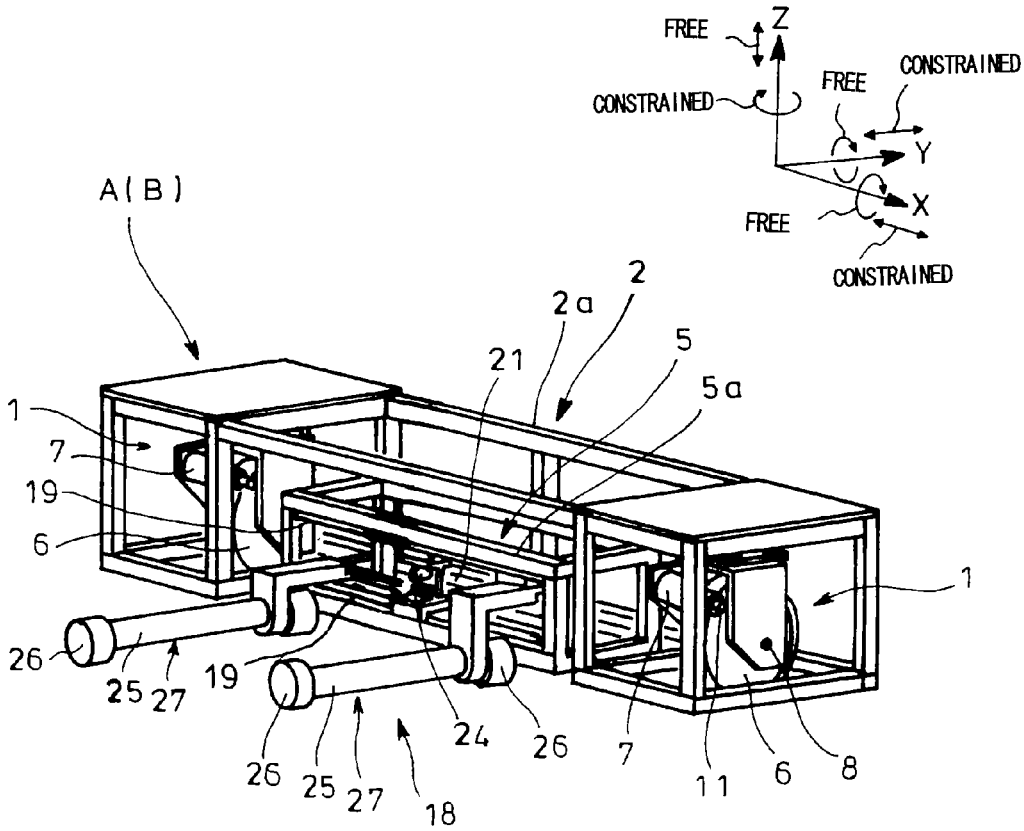
FIG. 21 is a perspective view showing a leader (or follower) carriage in the second embodiment of the invention.
Figure 22:
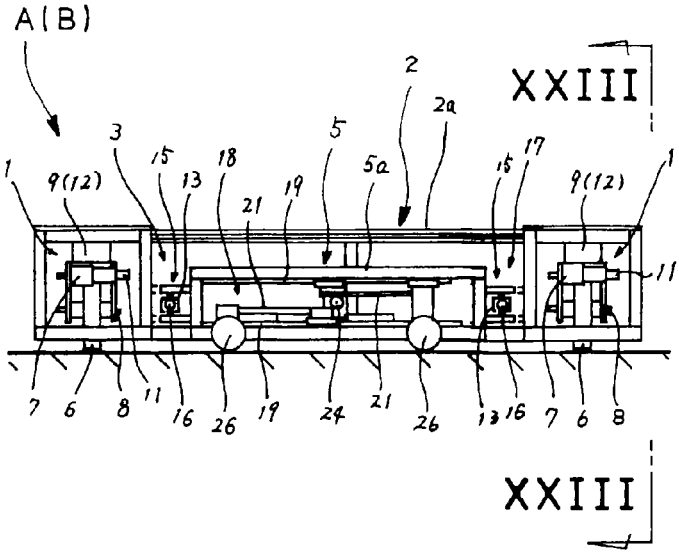
FIG. 22 is a front view showing the leader (or follower) carriage in the second embodiment of the invention, as seen in the direction of arrows XXII in FIG. 20.
Figure 23:
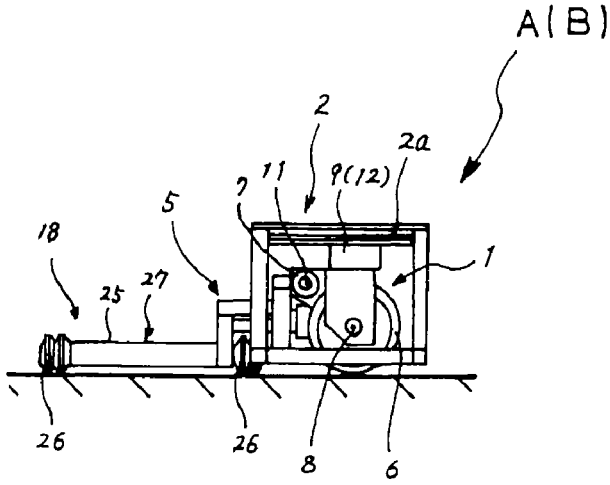
FIG. 23 is a side view showing the leader (or follower) carriage in the second embodiment of the invention, as seen in the direction of arrows XXIII in FIG. 22.
Figure 24:
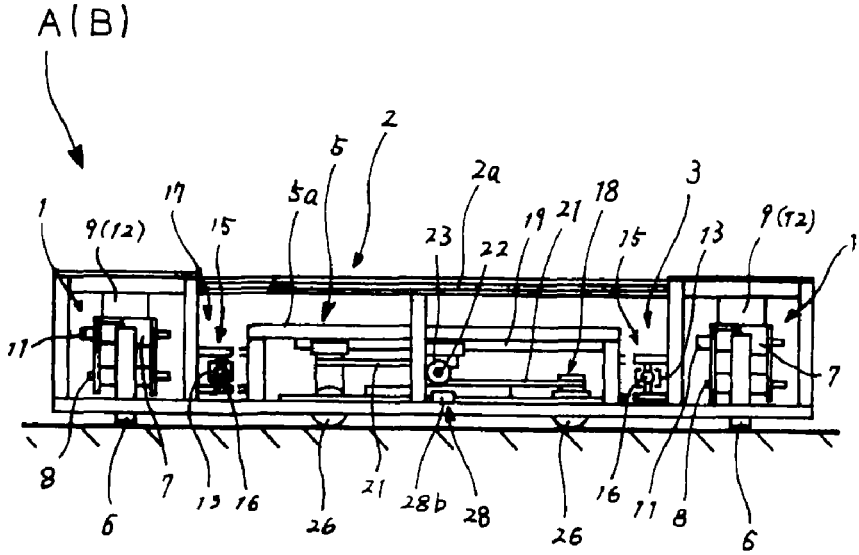
FIG. 24 is a rear view showing the leader (or follower) carriage in the second embodiment of the invention, as seen in the direction of arrows XXIV in FIG. 20.

Each of the link mechanisms 3 is similar in construction to the link mechanisms 3 in the first embodiment shown in FIGS. 1-14 and is provided by, as shown in FIGS. 20 and 9, a parallel linkage 17 comprising a plurality of (three in FIG. 20) link members 15 arranged on a single horizontal plane. Each of the link members 15 comprises a tension/compression load cell 13 as a force sensor and rods 14 attached to opposite ends of the load cell 13, respectively, and has one and the other ends connected through universal joints 16 to the carriage body 2 and the lifter 5, respectively. In this case, the lifter 5 is arranged on the carriage body 2 through the parallel linkage 17 (See FIGS. 20 and 9) such that, as shown in FIG. 21, constrained in total are three planar degree of freedom, i.e. two degrees of freedom to move in X and Y directions in the horizontal plane and one degree of freedom in a direction to rotate around a Z-axis orthogonal to the X and Y directions while made free are three degrees of freedom in total, i.e. one degree of freedom in a direction to rotate around the X-axis, one degree of freedom in a direction to rotate around the Y-axis and one degree of freedom in a direction to move along the Z-axis.

Figure 25:
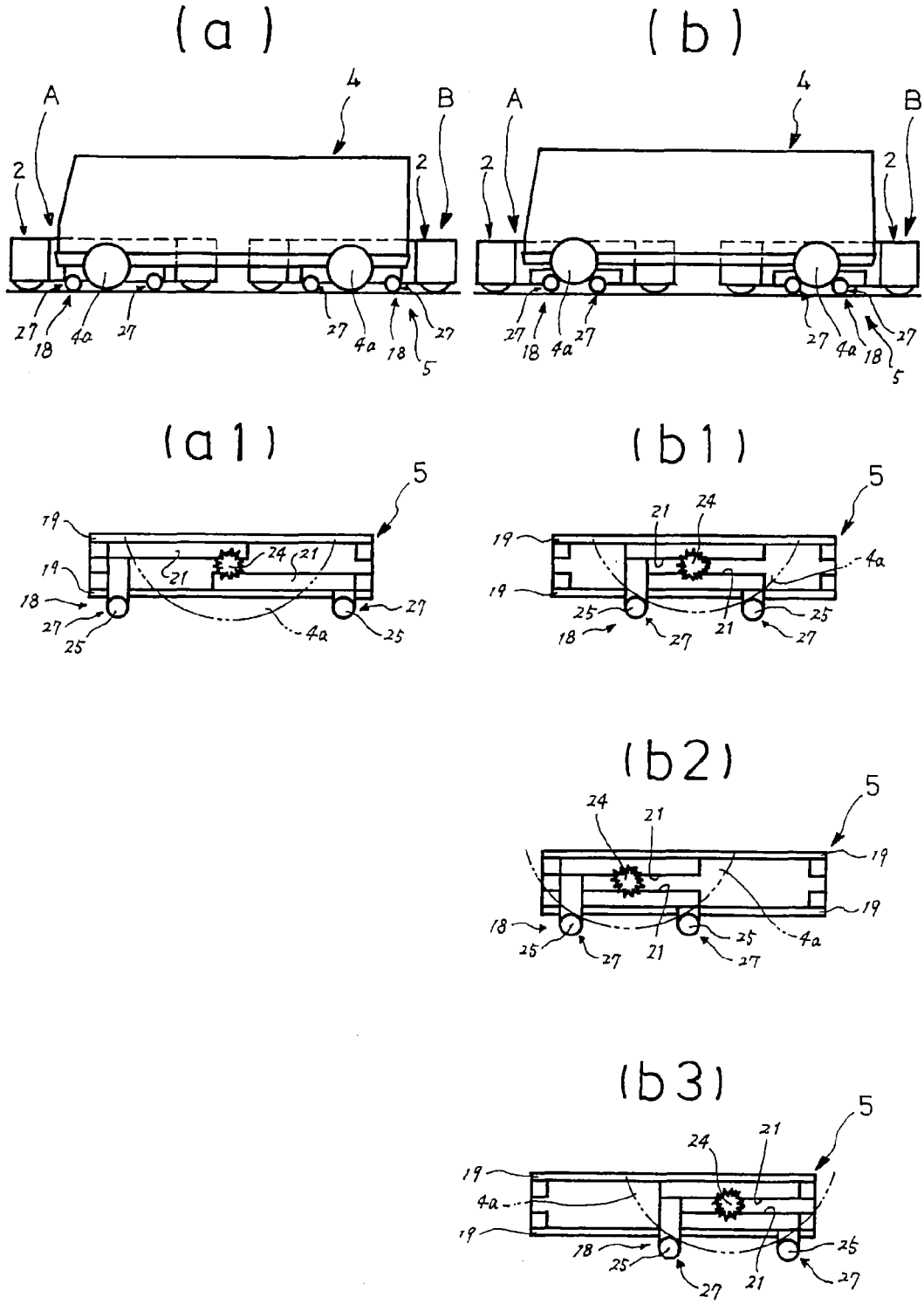
FIG. 25 is views for explanation of operational states of a wheel raising support of the lifter in the leader (or follower) carriage in the second embodiment of the invention, with FIG. 25(*a*) showing a state before supporting a vehicle, FIG. 25(*al*) showing a state of the paired lift bars being opened to their maximum separation, FIG. 25(*b*) showing of the vehicle being supported, FIG. 25(*b*1) showing a state of the lift bars being closed to their minimum separation, FIG. 25(*b*2) showing a state of the lift bars being closed while biased towards the left on the sheet shown, and FIG. 25(*b*3) showing a state of the lift bars being closed while biased towards the right on the sheet shown.

Each of the lifters 5 is similar in construction to the lifter 5 of the first embodiment shown in FIGS. 1-14 and, as shown in FIGS. 20-24 and 10, is provided with a wheel raising support 18 for support of the corresponding wheel 4*a* as ground point of the vehicle 4. In a lifter frame 5*a* attached to the carriage body 2 via the link mechanism 3, the wheel raising support 18 comprises a pair of rack guide rails 19 secured to extend in parallel with each other, a drive guide rail 20 secured to extend in parallel with the rack guide rails 19, a pair of rack members 21 slidably arranged along the rack guide rails 19 and having rack portions vertically confronting each other, a lift bar opening/closing actuators 23 such as a motor integral with a lift bar opening/closing sensor 22 such as an encoder slidably arranged along the drive guide rail 20, a drive pinion 24 meshed with both of the mutually confronting rack portions of the paired rack members 21 and rotatively driven by the actuators 23, lift bars 27 each having a wheel support roller 25 rotatably fitted over the bar and ground support wheels 26 at base and tip ends of the bar and projected at one and the other ends of the rack members 21 at right angles thereto, respectively, and a self-aligned-position retainer 28 arranged for keeping the actuator 23 at a desired position on the drive guide rail 20. Thus, as shown in FIG. 25, the paired lift bars 27 of the wheel raising support 18 of each of the lifters 5 are positioned fore and aft of the corresponding wheel 4*a* of the vehicle 4 and moved toward each other to lift up the vehicle 4.

Just like the wheel support roller 25 of the first embodiment shown in FIGS. 1-14, the wheel support roller 25 of the lift bar 27 is anti-slip surface-treated with, for example, knurling or painting with anti-slip paint.

Just like the ground support wheels 26 of the first embodiment shown in FIGS. 1-14, used as the ground support wheels 26 are omni-wheels 30 as shown in FIG. 11 such as Omni-wheels (registered trademark) as omni-directional wheels 29 movable omni-directionally without steering. Each of the omni-wheels 30 comprises a plurality of (two in FIG. 11) wheel units 30*e* provided along a wheel axle 30*b*; each of the wheel units 30*e* comprises a wheel body 30*a* circumferentially provided with a plurality of (three in FIG. 11) roller shafts 30*c* extending tangentially and perpendicular to the wheel axle 30*b* and with barrel-shaped rollers 30*d* each rotatably fitted over each of the roller shafts 30*c*. The second three of these rollers 30*d* are arranged in phase shift of 60° to the first three, so that when seen from the direction of the wheel axle 30*b*, it looks as if the six rollers 30*d* were arranged in a circle substantially provided by outsides of the six rollers 30*d*. Alternatively, usual casters may be used as the ground support wheels 26.

Each of the self-aligned-position retainers 28 is similar in construction to the self-aligned-position retainer in the first embodiment shown in FIGS. 1-14 and comprises, as shown in FIG. 20, a brake plate 28*a* integral with the lift bar opening/closing actuator 23 and extending in parallel with the drive guide rail 20 and an braking electromagnetic unit 28*b* secured in the lifter frame 5 and adapted to clamp the brake plate 28*a* to keep the actuator 23 in any desired position on the drive guide rail 20.

Figure 26:
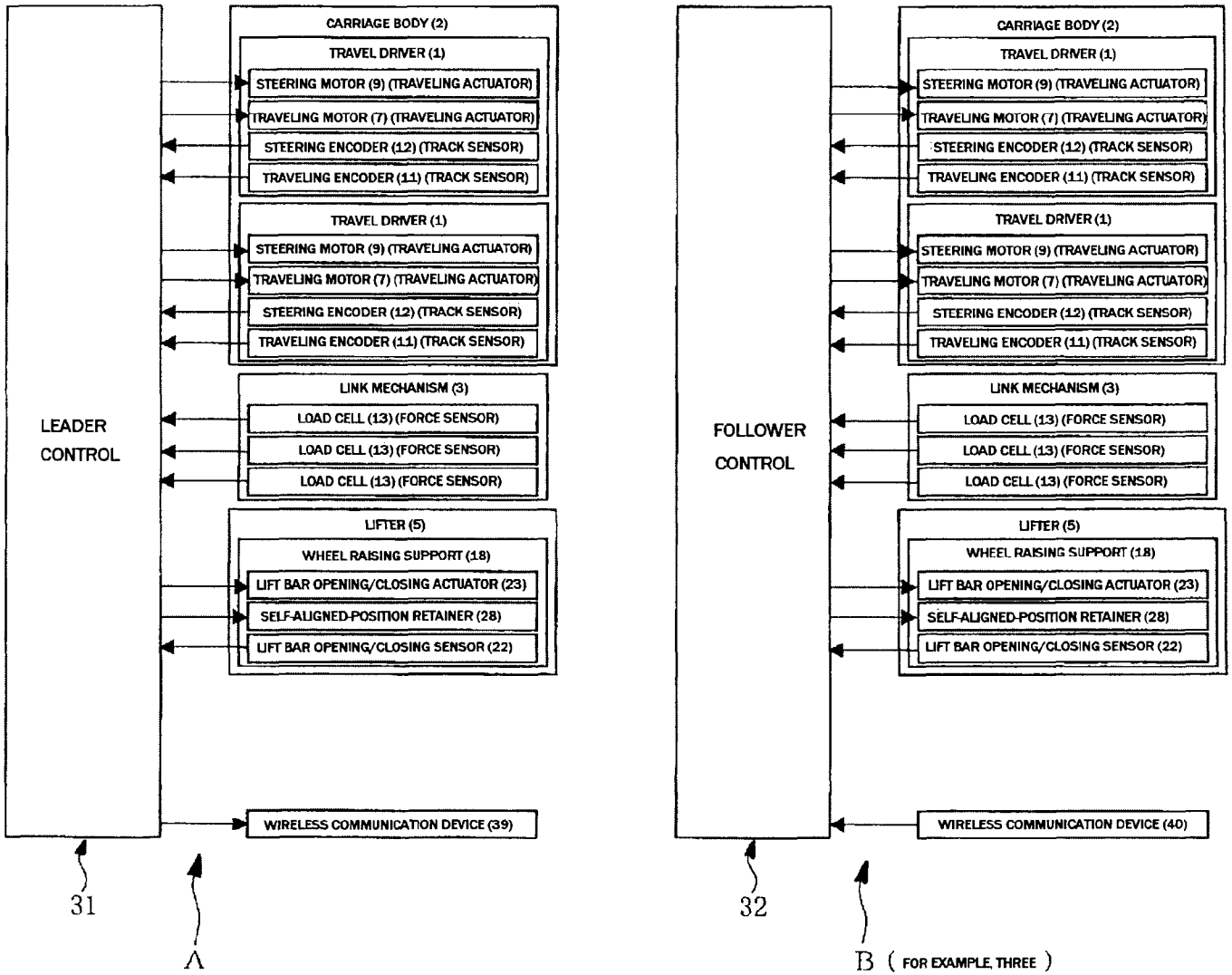
FIG. 26 is a block diagram showing overall control systems for the leader and follower carriages in the second embodiment of the invention.

FIG. 26 is a block diagram showing overall control systems of the leader and follower carriages A and B, respectively. A leader control 31 is mounted on the leader carriage A and is connected to the steering and traveling motors 9 and 7 as traveling actuators in the travel drivers 1 of that carriage body 2, to the steering and traveling encoders 12 and 11 as track sensors in the travel drivers 1 of that carriage body 2, to the load cells 13 as force sensors for the link mechanism 3, to the lift bar opening/closing actuator 23 and self-aligned-position retainers 28 in the vehicle raising supports 18 in the lifters 5, to the lift bar opening/closing sensors 22 in the vehicle raising supports 18 in the lifters 5 and to a wireless communication device 39 for transmission of control information to the follower carriage B. On the basis of detection signals by the load cells 13 as force sensors in the link mechanism 3 and by the steering and traveling encoders 12 and 11 as track sensors in the travel drivers 1 of the carriage body 2, drive signals are outputted to the steering and traveling motors 9 and 7 as traveling actuators in the travel drivers 1 of the carriage body 2; on the basis of the detection signals by the lift bar opening/closing sensors 22 in the wheel raising supports 18 in the lifters 5, drive signals are outputted to the lift bar opening/closing actuators 23 and self-aligned-position retainers 28 in the wheel raising supports 18 of the lifters 5, while the control information is transmitted by the wireless communication device 39 to the follower carriage B. On the other hand, a follower control 32 is mounted on the corresponding follower carriage B and is connected to the steering and traveling motors 9 and 7 as traveling actuators in the travel drivers 1 of the carriage body 2, to the steering and traveling encoders 12 and 11 as track sensors in the travel drivers 1 of the carriage body 2, to the load cells 13 as force sensors in the link mechanisms 3, to the lift bar opening/closing actuator 23 and self-aligned-position retainers 28 in the vehicle raising supports 18 of the lifters 5, to the lift bar opening/closing sensors 22 in the vehicle raising support 18 of the lifter 5 and to a wireless communication device 40 for receiving the control information from the leader carriage B. On the basis of detection signals by the load cells 13 as force sensors for the link mechanism 3 and by the steering and traveling encoders 12 and 11 as track sensors for the travel drivers 1 of the carriage body 2 and on the basis of the control information received by the wireless communication device 40 from the leader carriage A, drive signals are outputted to the steering and traveling motors 9 and 7 as traveling actuators in the travel drivers 1 of the carriage body 2; on the basis of the detection signals by the lift bar opening/closing sensors 22 in the wheel raising supports 18 of the lifters 5, drive signals are outputted to the lift bar opening/closing actuators 23 and self-aligned-position retainers 28 in the wheel raising supports 18 of the lifters 5.

Figure 27:
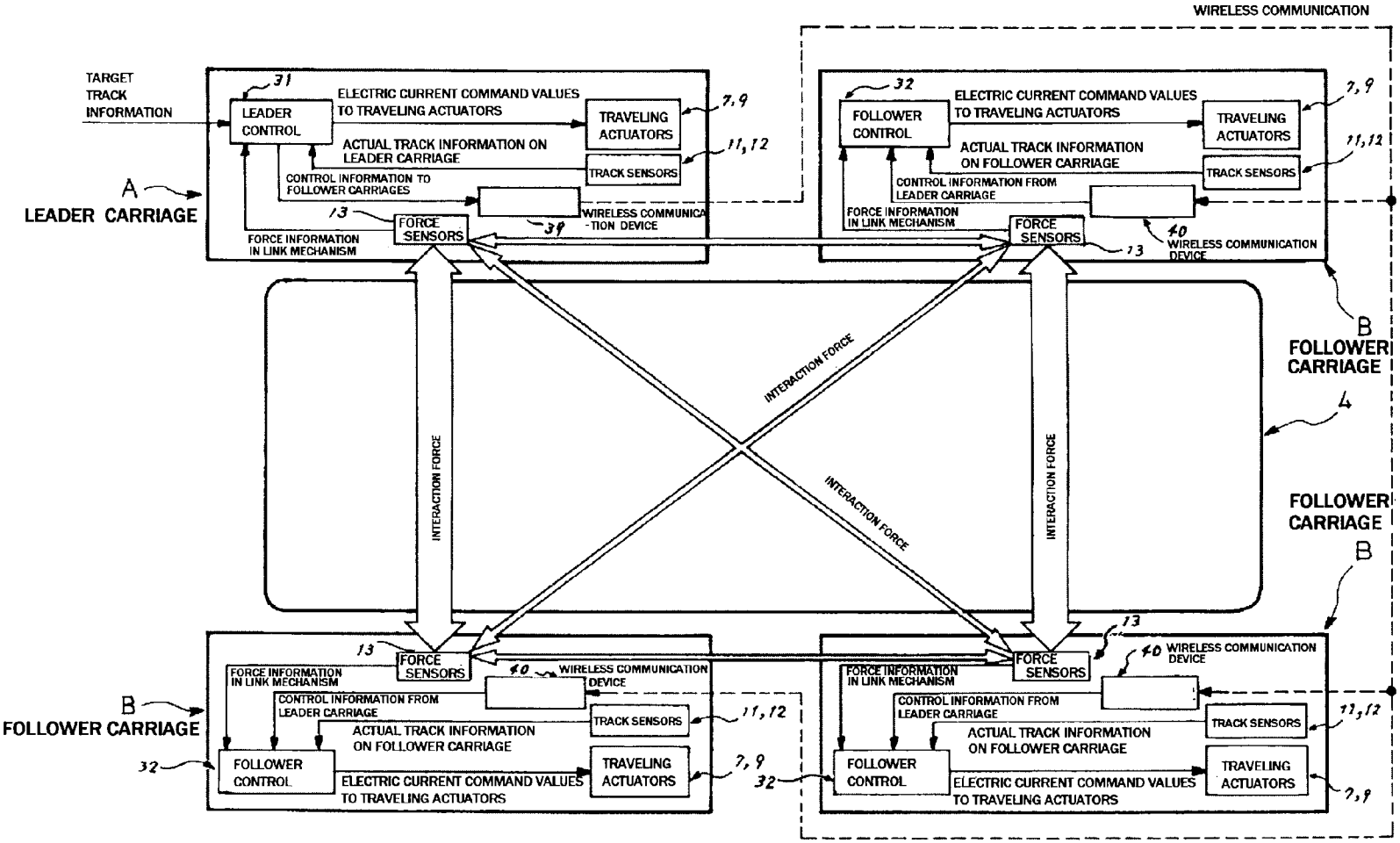
FIG. 27 is a system diagram related to coordinated control of the leader and respective follower carriages in the second embodiment of the invention.

The system for coordinated control of the leader carriage A and the plurality of (three in the example shown in the figures) follower carriages B will be described more specifically. As shown in FIG. 27, the interaction force via the vehicle 4 between the leader and respective follower carriages A and B is detected as force information by the load cells 13 as force sensors in the leader carriage A. Actual track information of the carriage body 2 of the leader carriage A is detected by the steering and traveling encoders 12 and 11 as track sensors. On the basis of the target track information inputted in advance, the force information detected by the load cells 13 as force sensors of the leader carriage A and the actual track information of the leader carriage A detected by the steering and traveling encoders 12 and 11 as track sensors, the leader control 31 outputs electrical current command values to the traveling actuators of the carriage body 2 of the leader carriage A and thereby causes the carriage body of the leader carriage A to move along the target track while transmitting the control information to the respective follower carriages B via the wireless communication device 39. On the other hand, the interaction force via the vehicle 4 between the leader carriage A and each of the follower carriages B is detected as force information by the load cells 13 as force sensors of each of the follower carriages B. Actual track information for the carriage body 2 of each of the follower carriages B is detected by its steering and traveling encoders 12 and 11 as track sensors. The control information from the leader carriage A by the wireless communication device 39 is received by each of the wireless communication devices 40. On the basis of the force information detected by the load cells 13 as force sensors of each of the follower carriages B, the actual track information for each of the follower carriages B detected by its steering and traveling encoders 12 and 11 as track sensors and the control information received by its wireless communication device 40 from the leader carriage A, the follower control 32 of each of the follower carriages B outputs electrical current command values to the traveling actuators of its carriage body 2 and thereby causes the carriage body 2 of each of the follower carriages B to follow the movement of the leader carriage A.

Figure 28:
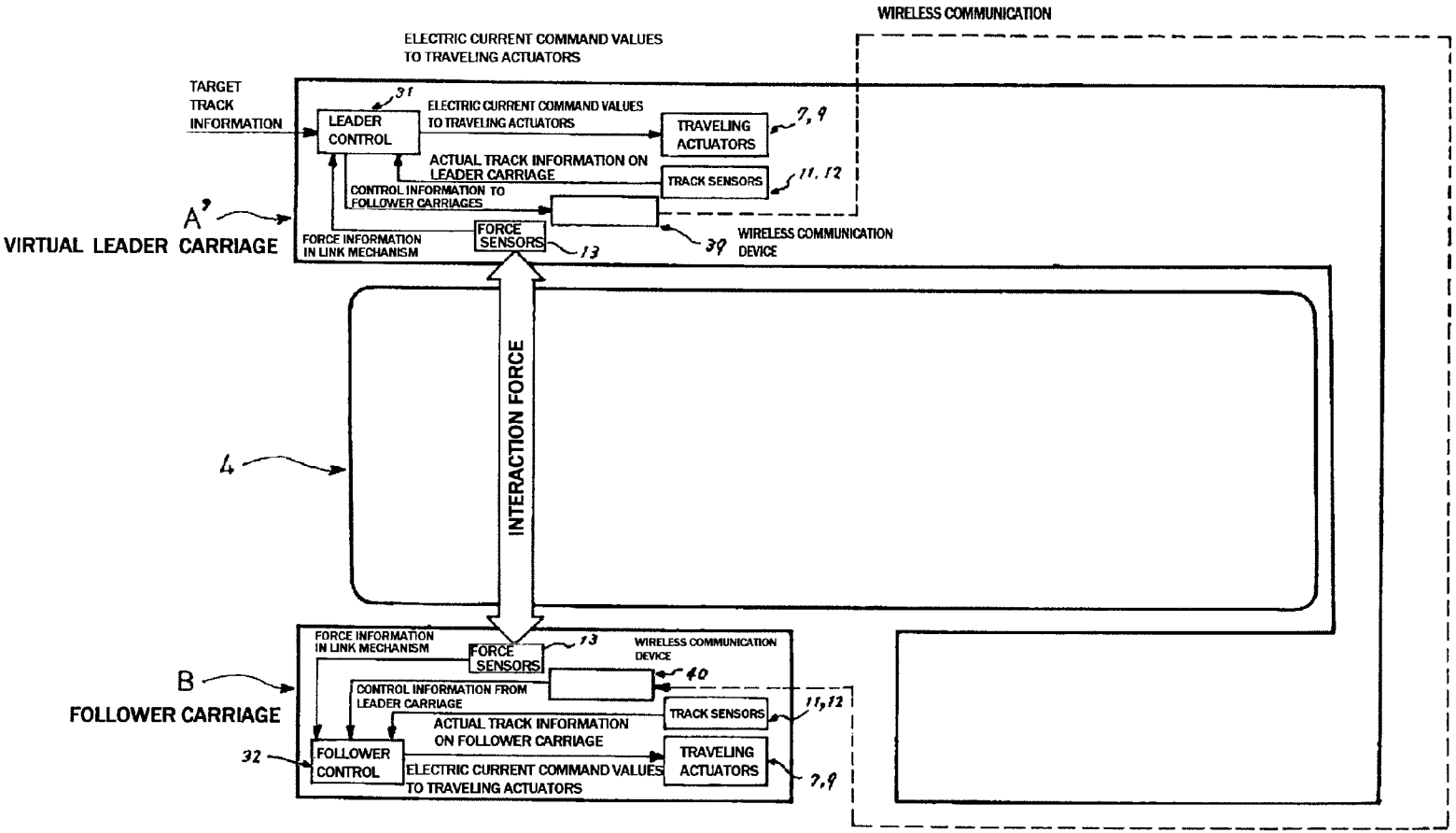
FIG. 28 is an image diagram of a virtual leader carriage with respect to one follower carriage in the second embodiment of the invention.

Since there are plural (three in the example shown) follower carriages B each experiencing, as shown in FIG. 27, influence from all of the carriages other than itself, it becomes impossible for the i-th follower carriage B to estimate the target track given to the leader carriage A. Thus, for the i-th follower carriage B, a first group is considered to be the i-th follower carriage B itself while a second group is considered to be a single virtual leader carriage A' (this is referred to as i-th virtual leader carriage A') which is a combination of the leader carriage A with the follower carriages B other than the i-th follower carriage B. Specifically, from a viewpoint of the i-th follower carriage B, the i-th virtual leader carriage A' is considered to act like a single leader carriage as shown in FIG. 28. When this virtual leader concept is employed, the i-th follower carriage B can estimate the target track of the i-th virtual leader carriage A', which is the combination of the leader carriage A with all the follower carriages B other than itself, using the way of estimating the target track when only one follower carriage B exists.

When disturbing factors such as inertial force and friction between the ground surface and the ground support wheels 26 of the lifters 5 affect the force information detected by the load cells 13, such disturbing factors may undesirably increase errors in the movement of the follower carriages B attempting to follow the movement of the leader carriage A. Thus, in order to move the vehicle 4 in a more stable state in coordination of the leader and respective follower carriages A and B, the control information for compensating such errors becomes necessary which is transmitted by the leader control 31 via the wireless communication device 39 of the leader carriage A to the wireless communication device 40 of each of the follower carriages B, so that calculation of compensation of the errors is performed by each of the follower controls 32 on the basis of the control information.

When the three link members 15 each with the tension/compression load cell 13 as force sensor being interposed are arranged as the parallel linkage 17 with constrain of three planar degrees of freedom as shown in FIG. 20, values detected by these load cells 13 may be coordinate-converted with a Jacobian matrix to obtain forces exerted as external forces on the lifter 5 as force information for the three planar degrees of freedom.

Figure 29:
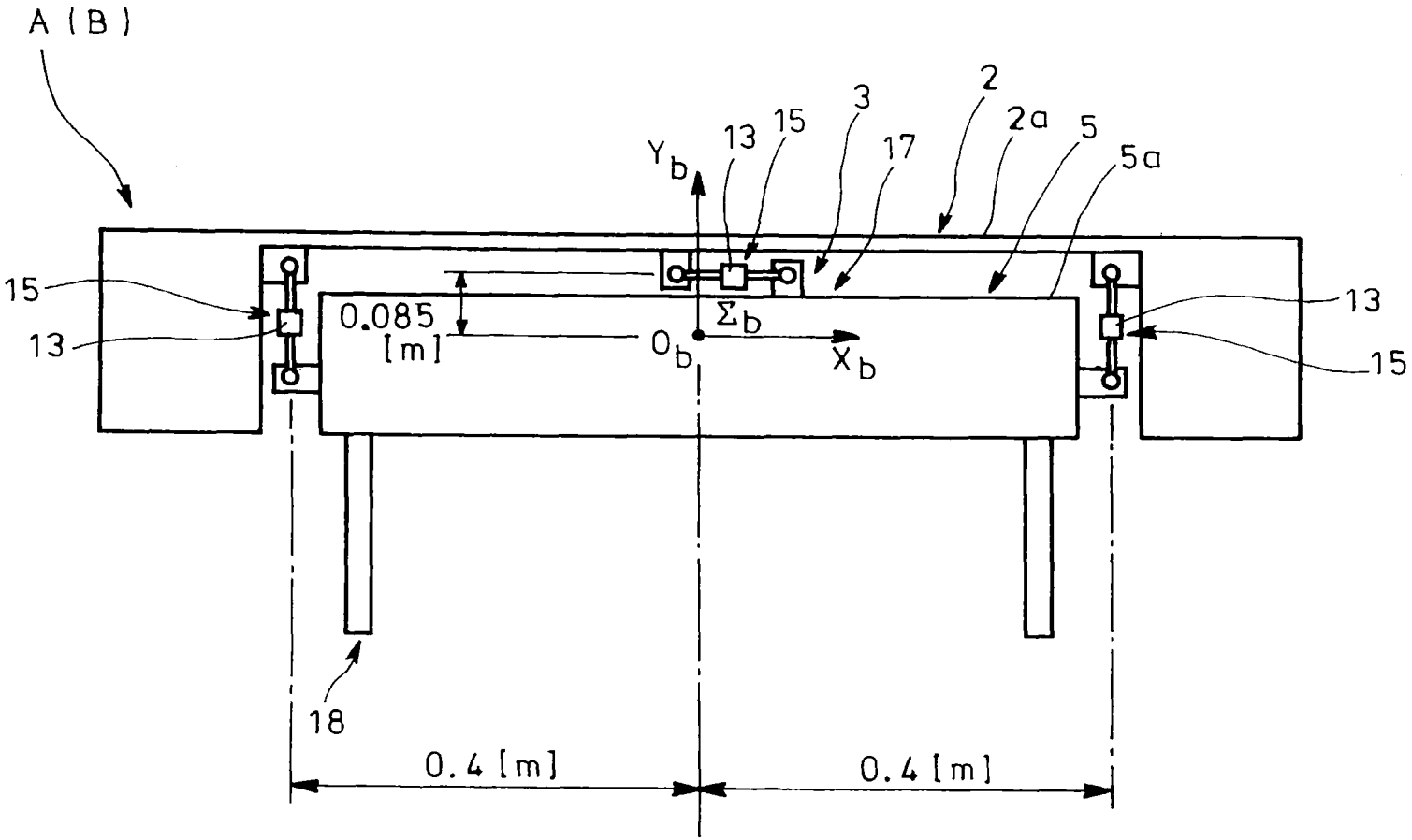
FIG. 29 is a plan view showing a coordinate system used when calculating a force vector applied to a lifter in the second embodiment of the invention.

Specifically, if $O_b$ is taken as the origin and a coordinate system $\Sigma_b$ with axes $X_b$-$Y_b$ is assumed as shown in FIG. 29, then the force vector F acting on the lifter 5 is given by Equation 1 mentioned above. The origin $O_b$, which may be set at any desired position, is set at the central plane of the leader carriage A (or the follower carriage B) in the example shown in FIG. 29 for the sake of easy calculation.

Since the transposed matrix $J_I^T$ of the Jacobian inverse matrix for the parallel linkage 17 and the information $f_s$ on the force applied to the link members 15, are respectively given by the Equation 2 mentioned above. Therefore, according to Equations 1 and 2, Equation 3 is obtained.

In this connection, in the example shown in FIG. 28, the transposed matrix $J_I^T$ of the Jacobian inverse matrix for the parallel linkage 17 is given by:

$$J_I^T = \begin{bmatrix} 0 & 1 & 0 \\ -1 & 0 & -1 \\ 0.4 & 0.085 & -0.4 \end{bmatrix} \quad \text{[Equation 6]}$$

And therefore:

$$\begin{aligned} X &= a_{11} \cdot f_1 + a_{12} \cdot f_2 + a_{13} \cdot f_3 \\ &= f_2 \end{aligned} \quad \text{[Equation 7]}$$

-continued $$\begin{aligned} y &= a_{21} \cdot f_1 + a_{22} \cdot f_2 + a_{23} \cdot f_3 \\ &= -f_1 - f_3 \end{aligned}$$

$$\begin{aligned} \theta &= a_{31} \cdot f_1 + a_{32} \cdot f_2 + a_{33} \cdot f_3 \\ &= 0.4f_1 + 0.085f_2 - 0.4f_3 \end{aligned}$$

Thus, the respective values of Equation 7 are calculated from the values detected by the load cells 13. The steering angles and the rotational speeds of the traveling wheels 6 of the travel drivers 1 of the carriage bodies 2 are determined on the basis of the calculated values of Equation 7, so that drive signals can be outputted to the steering and traveling motors 9 and 7 as traveling actuators so as to bring a sum of the force vectors F imposed upon the lifters 5 of the virtual leader and follower carriages A' and B to fundamentally zero, whereby the vehicle 4 can be moved while performing coordinated control of the virtual leader and follower carriage A' and B.

The basic concept on the coordinated control of the leader and follower carriages A and B as well as the fact that, in a case of plural follower carriages, a concept of a virtual leader carriage can be applied for an i-th follower carriage to estimate target track of a single i-th virtual leader carriage A' which is a combination of the leader carriage A with the follower carriages other than itself in a manner similar to estimate the target track of the leader carriage when only one follower carriage B exists, are disclosed in "Decentralized Control of Multiple Mobile Robots Handling a Single Object in coordination", Journal of the Robotics Society of Japan, vol. 16, No. 1, pp. 87-95, by Kazuhiro Kosuge, Tomohiro Oosumi and Kunihiko Chiba.

Next, mode of operation of the second embodiment will be disclosed.

First, with the vehicle 4 stopped, the leader carriage A is caused to travel to bring the lift bars 27 of the wheel raising support 18 of its lifter 5 to be positioned fore and aft of one wheel 4*a* as a ground point of the vehicle. Then, the follower carriages B are caused to travel to bring the lift bars 27 of the wheel raising supports 18 of their lifters 5 to be positioned fore and aft of the other wheels 4*a* as the other ground points of the vehicle, respectively.

Next, with the self-aligned-position retainers 28 being released, the lift bar opening/closing actuators 23 of the wheel raising supports 18 of the lifters 5 are rotationally driven in desired directions according to the drive signals from the leader and follower controls 31 and 32 to move the respective paired lift bars 27 from the state shown in FIGS. 25(*a*) and 25(*a*1) toward each other, so that, as shown in FIGS. 25(*b*) and 25(*b*1), the wheels 4*a* of the vehicle 4 are caused to rest on the lift bars 27, whereby the vehicle 4 is lifted up.

In this connection, the lift bar opening/closing actuator 23 is arranged slidably along the guide rail 20, so that, when the lift bar 27 located fore of the vehicle 4 (on the left in FIG. 25) in the fore-and-aft directions first comes into contact with the wheel 4*a* as shown in FIG. 25(*b*2) during the movement of the paired lift bars 27 toward each other, the other lift bar located aft of the vehicle 4 (on the right in FIG. 25) in the fore-and-aft direction will move forward; and conversely, when the lift bar 27 located aft of the vehicle 4 in the fore-and-aft directions first comes into contact with the wheel 4*a* as shown in FIG. 25(*b*3), the other lift bar located fore of the vehicle 4 will move backward. Thus, even if the stopped positions of the leader and follower carriages A and B with respect to the wheels 4*a* of the vehicle 4 are deviated more or less in the fore-and-aft directions of the wheels 4*a*, it do not exert any influence and the lift bar opening/closing actuators 23 are inevitably self-aligned and centrally positioned in the fore-and-aft directions of the wheels 4*a*. After the vehicle 4 is lifted up, the brake plates 28*a* integral with the lift bar opening/closing actuators 23 and extending in parallel with the drive guide rails 20, respectively, are clamped by the braking electromagnetic units 28*b* of the self-aligned-position retainers 28 fixed within the lifter frames 5*a* so that the opening/closing actuators 23 are kept at the desired positions on the drive guide rails 20 and the lift bars 27 are locked.

As shown in FIG. 27, with the target track information being inputted in advance to the leader control 31 of the leader carriage A, the electrical current command values are outputted to the steering and traveling motors 9 and 7 as traveling actuators of the carriage body of the leader carriage A to move the carriage body 2 of the leader carriage A along the target track while the control information is transmitted by the wireless communication device 39 of the leader carriage A to each of the follower carriages B. Simultaneously with this, the interaction force between the leader carriage A and each of the follower carriages B via the vehicle 4 is detected as force information by the load cells 13 as force sensors of each of the follower carriages B, the actual track information for the carriage body 2 of each of the follower carriages B is detected by its steering and traveling encoders 12 and 11 as track sensors and the control information transmitted from the leader carriage A by its wireless communication device 39 is received by the wireless communication device 40 of each of the follower carriages B. On the basis of the force information detected by the load cells 13 as force sensors of each of the follower carriages B, the actual track information detected by the steering and traveling encoders 12 and 11 as track sensors of each of the follower carriages B and the control information from the leader carriage A received by the wireless communication device 40, electrical current command values are outputted by the follower controls 32 to the traveling actuators of the carriage body of each of the follower carriages B, so that the carriage body 2 of each of the follower carriages B follows the movement of the leader carriage A. Thus, even if some disturbing factors such as inertial force and friction between the ground surface and the ground support wheels 26 of the lifter 5 affect the force information detected by the load cells 13 for following of the carriage body 2 of each of the follower carriages B to the movement of the leader carriage A, the control information necessary for compensating such errors in the movement of the follower carriages B attempting to follow the movement of the leader carriage A is transmitted by the leader control 31 via the wireless communication device 39 of the leader carriage A and is received by the wireless communication device 40 of each of the follower carriages B, and the calculation of compensation for the errors is performed by the follower controls 32 on the basis of the control information, so that the vehicle 4 can be moved in coordination of the leader and respective follower carriages A and B in a more stabilized state. For movement of the vehicle 4 by coordination of the leader and respective follower carriages A and B, when with respect to the i-th follower carriage B, a first group is considered to be the i-th follower carriage B itself and a second group is considered to be a single virtual leader carriage A' (this is referred to as i-th virtual leader carriage A') which is a combination of the leader carriage A with the follower carriages B other than the i-th follower carriage B as shown in FIG. 28, then the i-th virtual leader carriage A' acts like a single leader carriage from the viewpoint of the i-th follower carriage B as shown in FIG. 28. By employing this virtual leader concept, the i-th follower carriage B can estimate the target track of the single i-th virtual leader carriage A' which is the combination of the leader carriage A with all the follower carriages B other than itself, using the way of estimating the target track when only one follower carriage B exists.

When the leader and respective follower carriages A and B reach the target point, then in a manner converse to the operation described above, the self-aligned-position retainers 28 are released, the paired lift bars 27 are driven in the directions away from each other to lower down the vehicle 4 having rested on the lift bars 27 on a destination point and then the leader and respective follower carriages A and B are retracted laterally away from the vehicle 4.

Thus, when the leader carriage A is moved along the target track with the vehicle 4 been lifted up by the lifters 5 of the leader and respective follower carriages A and B, each of the follower carriages B can estimate and follow the movement of the single virtual leader carriage A' which is the combination of the leader carriage A with all the follower carriages other than itself to thereby move the vehicle 4 in coordination with the leader carriage A. In the control method based upon real-time information exchange between the carriages by wireless communication, there is no fear that the object such as the vehicle may fall down and/or suffer damage due to interruption or delay of information because of communication breakdown.

Moreover, even if the object to be moved is a long wheel base vehicle 4 such as a bus or a vehicle 4 with a large number of wheels 4*a* as ground points, it is no longer necessary to make the moving apparatus itself large-sized or to separately provide a moving apparatus with a special mechanism suitable for the large number of wheels 4*a*, so that there is no need to have increased kinds of moving apparatuses. Since the moving apparatus does not require large-zed, it is unnecessary to dedicate a great deal of space for moving pathway and storage.

During coordinated conveyance of the vehicle 4 supported between the leader and respective follower carriages A and B, if the vehicle 4 weighs not so much, there is a danger that the wheels 4*a* of the vehicle 4 might slip on the wheel support rollers 25 of the lift bars 27, resulting in an obstacle to the coordinated conveyance procedure; however, since the surfaces of the wheel support rollers 25 of the lift bars 27 are subjected to anti-slip processing by knurling or painting with anti-slip paint and the wheels 4*a* of the vehicle 4 on the wheel support rollers 25 of the lift bars 27 are prevented from slipping even if the vehicle 4 is light-weight, so that there is no fear that any obstacle to the coordinated conveyance procedure may arise.

Thus, unlike the coordinate conveyance with real-time information exchange only the wireless communication, without fear that the vehicle 4 may fall down and/or suffer damage, the vehicle 4 can be moved reliably and more stably by coordinated control of plural carriages with no fear of the object such as the vehicle falling off and/or suffering damage. Without increasing the number of kinds of apparatuses, the apparatus can cope with various objects such as vehicles with different sizes and/or with different numbers of ground points so that space needed for moving pathway and for storage can be reduced.

Figure 30:
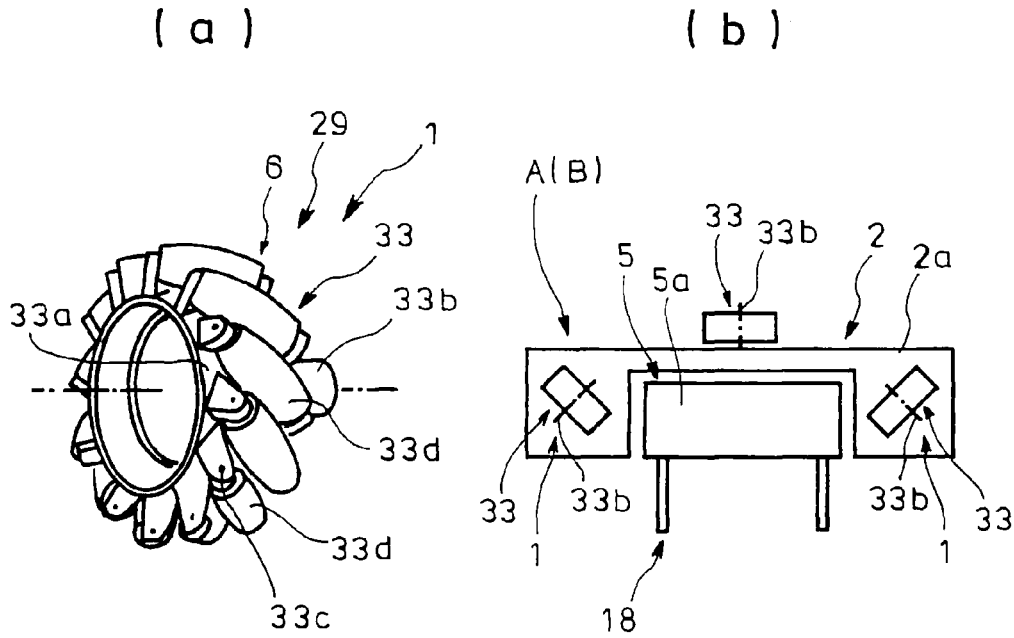
FIG. 30 is views showing a modification of a travel driver for the second embodiment of the invention, with FIG. 30(*a*) being a perspective view showing a mecanum wheel as an omni-directional mobile wheel, and FIG. 30(*b*) being a plan view showing an example of the arrangement of the mecanum wheels.

FIG. 30 shows a modification of the travel drivers 1 in the second embodiment. The traveling wheels 6 of the carriage body 2 are provided by the omni-directional mobile wheels 29 requiring no steering. As shown in FIG. 30(*a*), each of the omni-directional mobile wheels 29 is provided by a mecanum wheel comprising a wheel body 33*a* circumferentially provided with a plurality of roller shafts 33*c* tilted at 45° with respect to a wheel axle 33*b* and with rollers 33*d* each rotatably fitted over each of the roller shafts 33*c*. As shown in FIG.

30(*b*), at opposite ends and at an intermediate portion of the moving base frame 2*a* of the carriage body 2, totally three of the mecanum wheels 33 are arranged.

In the example shown in FIG. 30(*b*), the two mecanum wheels 33 at the opposite ends of the moving base frame 2*a* of the carriage body 2 are arranged with their wheel axles 33*b* extending horizontally with phase shift of 90° to each other and angled at 45° with respect to the longitudinal direction of the carriage body 2. The single mecanum wheel 33 at the intermediate portion of the moving base frame 2*a* of the carriage body 2 has the wheel axle 33*b* which extends horizontally and is angled at 90° with respect to the longitudinal direction of the carriage body 2.

With this structure, in the second embodiment of the invention as well, appropriate adjustment of balance in rotation between the three mecanum wheels 33 makes it possible to move the carriage body 2 in any desired direction and to orient the lifter 5 in any desired direction.

In comparison with the steering and traveling motors 9 and 7 being used as traveling actuators (see the example of FIGS. 20-8) where two each, i.e. total four motors are required for one carriage body 2, the modification of FIG. 30 is advantageous in that three motors will suffice as traveling actuators.

In place of such mecanum wheels 33, the omni-directional mobile wheels 29 in the second embodiment of the invention may be also provided by the omni-wheels 30 as shown in FIG. 11 each comprising a plurality of wheel units 30*e* provided along a wheel axle 30*b*, each of the wheel units comprising a wheel body 30*a* circumferentially provided with a plurality of roller shafts 30*c* extending tangentially and perpendicular to the wheel axle 30*b* and with barrel-shaped rollers 30*d* each rotatably fitted over each of the roller shafts 30*c*.

Figure 31:
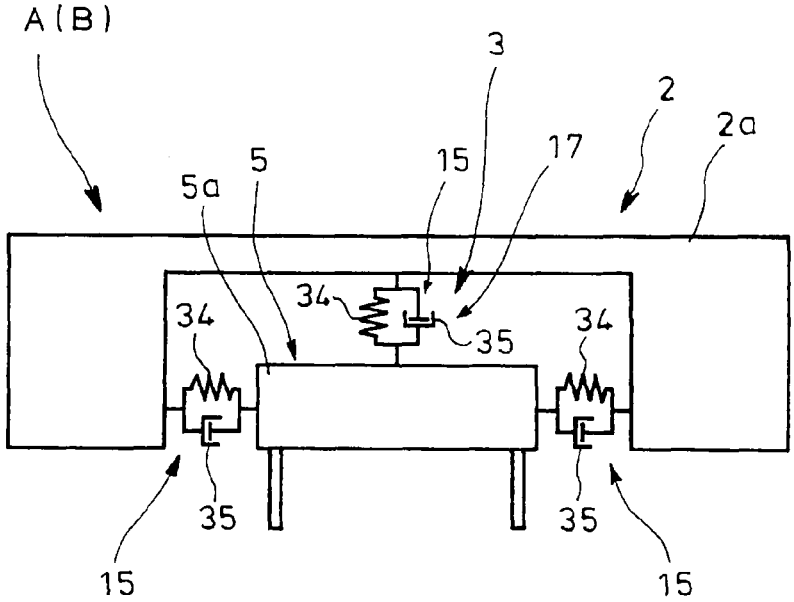
FIG. 31 is a plan view showing a modification of the link mechanism.

Each of the link members 15 for the parallel linkage 17 providing the link mechanism 3 in the second embodiment of the invention may alternatively comprise, as shown in FIG. 31, a displacement-detectable spring 34 and a displacement-detectable damper 35. Displacements of the members are detected; and information on forces exerted on the lifters 5 is calculated on the basis of spring constants obtained and viscous coefficients of the dampers 35, so that coordinated control of the leader and respective follower carriages A and B can be performed. Usable as the displacement-detectable spring 34 is, for example, a spring with a distance measurement beam sensor at its one end and a reflecting plate at its other end so as to measure the displacement. In a similar manner, usable as the displacement-detectable damper 35 is, for example, a damper with a distance measurement beam sensor at its one end and a reflecting plate at its other end so as to measure the displacement.

The construction as shown in FIG. 31 is much effective for preventing undesirable deformation and/or damage from taking place on the leader and respective follower carriages A and B and the vehicle 4 when forces (internal forces or stresses) are generated on the carriages A and B and the vehicle 4 that are greater than strengths of the respective parts.

In the example shown in FIG. 31, each of the link members 15 of the parallel linkage 17 is constituted by both the displacement-detectable spring 34 and the displacement-detectable damper 35. Alternatively, the link member may be constituted by only the displacement-detectable spring 34 or only by the displacement-detectable damper 35.

Figure 32:
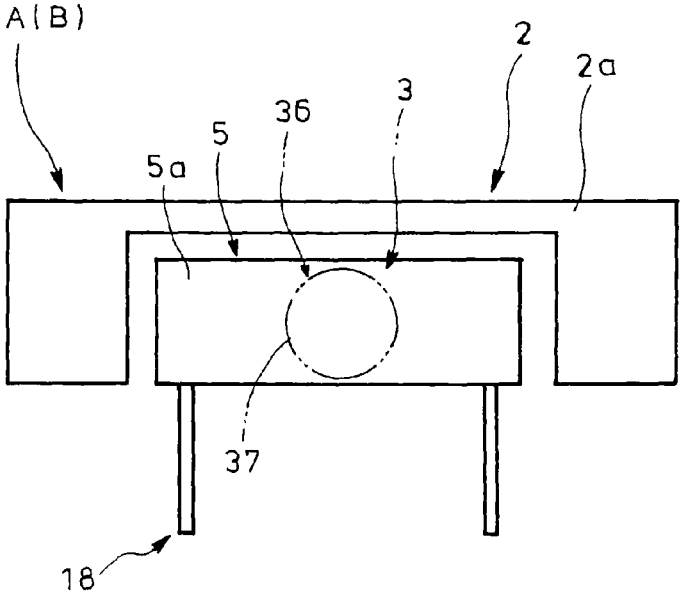
FIG. 32 is views showing a further modification of the link mechanism, with FIG. 32(*a*) being a planar arrangement figure, and FIG. 32(*b*) being a perspective view.
Figure 32:
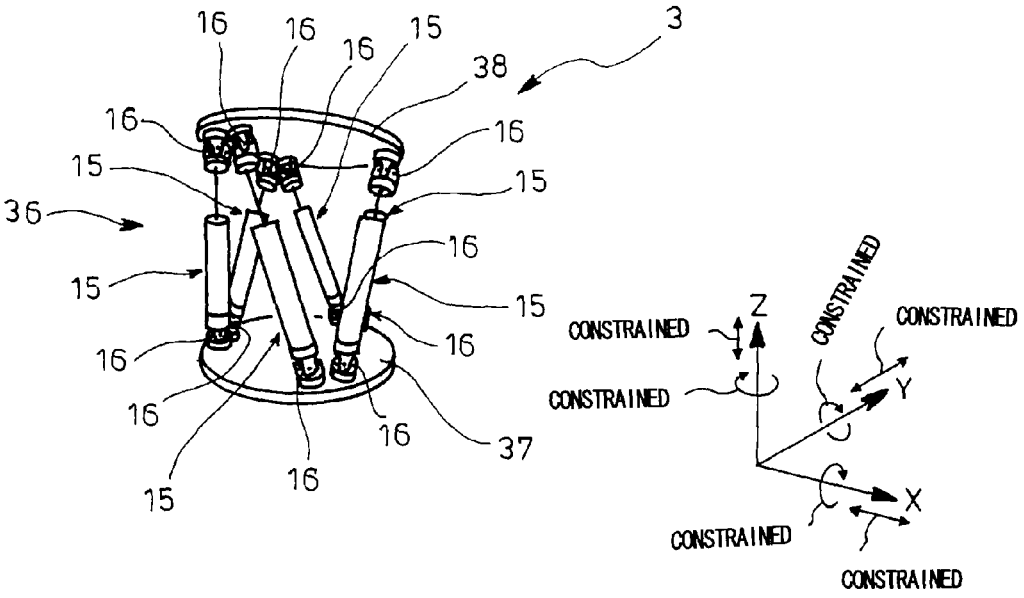

As shown in FIGS. 32(*a*) and 32(*b*), the link mechanism 3 in the second embodiment of the invention may be alternatively provided by a spatial parallel linkage 36 comprising a plurality of spatially arranged link members 15 each serving as force sensor (six displacement-detectable dampers in the example of FIG. 32) and each with one end linked on the side of the carriage body 2 by a universal joint 16 and the other end linked on the side of the lifter 5 by a universal joint 16. Thus, to the carriage body 2 via the spatial parallel linkage 36, the lifter 5 is constrained totally in six degrees of freedom: i.e. two degrees of freedom to move in X-Y directions in the horizontal plane, one degree of freedom to rotate about a Z-axis orthogonal to the X and Y directions, one degree of freedom to rotate about the X-axis, one degree of freedom to rotate about the Y-axis and one degree of freedom to move along the Z-axis.

In the spatial parallel linkage 36 in the second embodiment of the invention, a lower base plate 37 as shown in FIG. 32(*b*) is secured to an upper surface of the lifter 5 at a central portion thereof as shown in FIG. 32(*a*) and an upper base plate 38 is secured to a lower surface of the moving base frame 2 in a corresponding position, the six rink members 15 in the form of the displacement-detectable dampers being interposed between the upper and lower base plates 38 and 37.

When the linkage is constructed as shown in FIGS. 32(*a*) and 32(*b*) and the space is expressed in terms of the X-Y-Z coordinates, the six link members 15 in the form of the displacement-detectable dampers can derive forces in the directions of the respective axes and moments around the axes. As a result, while influences due to undulations of the ground surface and the like is absorbed to alleviate disturbances caused thereby, coordinated control of the leader and respective follower carriages A and B can be performed more stably.

In the example shown in FIG. 32, the link members 15 for the spatial parallel linkage 36 are provided only by the displacement-detectable dampers; alternatively, the link members 15 may be provided only by displacement-detectable springs or may be provided by both the displacement-detectable springs and dampers.

When the ground support wheels 26 of the lifter 5 and/or the traveling wheels 6 of the carriage body 2 in the second embodiment of the invention are provided by omni-wheels 30 (see FIG. 11) as omni-directional wheels 29 requiring no steering, vibrations will occur due to the structure of the omni-wheels 30 during rotation thereof about the wheel axles 30 since the respective three rollers 30*d* for each of two wheel units 30*e* in sequence constituting the omni-wheel come alternately in contact with the ground surface. Such vibrations during the rotation of the omni-wheels may be suppressed by constituting, as shown in FIG. 19, each of the omni-wheel by a plurality of (three in FIG. 19) wheel units 30*e* arranged in sequence along a wheel axle 30*b* each comprising a wheel body 30*a* circumferentially provided with a plurality of (three in FIG. 19) roller shafts 30*c* extending tangentially and perpendicular to the wheel axle 30*b* and with the barrel-shaped rollers 30*d* each rotatably fitted over each of the roller shafts 30*c*. As a result, the force control can be performed more stably since adverse effects in the form of noises on the force sensors by vibrations is suppressed.

In this connection, also in the second embodiment of the invention, when the omni-wheel is provided by the three wheel units 30*e* arranged in sequence along the wheel axle 30*b* and contacts the ground at opposite two of them, resistance during rotation about the wheel axle 30*b* becomes greater than when only two wheel units 30*e* are provided in sequence along the wheel axle 30*b*. However, this situation may be considered to be equivalent to steering with tire surfaces in surface contact with the ground; accordingly it will suffice to provide power sources enhanced, in consideration of friction resistance increased, for supply of power to the traveling actuators of the travel drivers 1.

It also goes without saying that not only Omniwheels (registered trademark) and mecanum wheels but also various types of wheels may be employed in the second embodiment of the invention. For example, usable are wheels of a type in which rotating members with flexible rotation axes are arranged on an outer circumference of a wheel body in such a manner that each of the rotating members are rotatably supported at its opposite ends by adjacent support members as shown in JP 2006-16859A and in Japanese Utility Model Registration 3,130,323 or special wheels with free rollers described in Development of an Omni-Directional and Step-Climbing Mobile Robot, Abstracts of the 17th Annual Conference of the Robotics Society of Japan, pp. 913-914, September 1999, by Tatsuya Kanazawa, Atsushi Yamashita, Hajime Asama, Hayato Kaetsu, Isao Endo, Tamio Arai and Kazumi Sato.

It is to be understood that an object moving apparatus of the invention is not limited to the above embodiment and that various changes and modifications may be made without departing from the scope of the invention. For example, the vehicle in question is not limited to a four wheeled car; the invention may be also applied to any vehicle having a plurality of wheels. The invention is not limited to usage in a parking facility, but may be also applied to, for example, movement of vehicles that have committed parking offences or movement of vehicles in the interior of a car ferry. The invention may be also applied to an object other than a vehicle.

The invention claimed is:

1. An object moving apparatus, characterized by comprising:

a leader carriage comprising a carriage body travelable in all directions by travel drivers and a lifter attached to said carriage body via a link mechanism for lifting up an object, said leader carriage being movable along a given target track;

a follower carriage comprising a carriage body travelable in all directions and a lifter attached to said carriage body via a link mechanism for lifting up said object, said follower carriage estimating and following movement of said leader carriage so as to move the object in coordination with said leader carriage;

traveling actuators for movement of said carriage body of said leader carriage in a desired direction;

force sensors installed in said link mechanism of said leader carriage for detecting as force information interaction force between the leader and follower carriages via the object;

track sensors for detecting actual track information of said carriage body of said leader carriage;

a wireless communication device for transmitting control information to said follower carriage;

a leader control for outputting, on the basis of target track information, the force information detected by said force sensors of said leader carriage and the actual track information detected by said track sensors of said leader carriage, electric current command values to said traveling actuators of said carriage body of said leader carriage for movement of said carriage body of said leader carriage along the target track, said leader control also sending control information to said follower carriage via said wireless communication device;

traveling actuators for movement of said carriage body of said follower carriage in a desired direction;

force sensors installed in said link mechanism of said follower carriage for detecting as force information interaction force between the leader and follower carriages via the object;

track sensors for detecting actual track information for said carriage body of said follower carriage;

a wireless communication device for receiving the control information from said leader carriage; and a follower control for outputting, on the basis of the force information detected by said force sensors of said follower carriage, the actual track information detected by said track sensors of said follower carriage and the control information received from said leader carriage by the wireless communication device, electric current command values to said traveling actuators of said carriage body of said follower carriage so that the carriage body of said follower carriage may follow the movement of said leader carriage;

the link mechanism being provided by a parallel linkage comprising a plurality of link members arranged on a single horizontal plane, each of the link members serving as a force sensor and having one and the other ends connected through universal joints to the carriage body and the lifter, respectively, the lifter being arranged on the carriage body through the parallel linkage such that constrained in total are three planar degrees of freedom, two degrees of freedom to move in X and Y directions in the horizontal plane and one degree of freedom in a direction to rotate around a Z-axis orthogonal to the X and Y direction while made free are three degrees of freedom in total, one degree of freedom in a direction to rotate around the X-axis, one degree of freedom in a direction to rotate around the Y-axis and one degree of freedom in a direction to move along the Z-axis.

2. An object moving apparatus as claimed in claim 1, wherein each of said link members comprises said force sensor with rods at opposite ends of the sensor, respectively.

3. An object moving apparatus as claimed in claim 1, wherein the link member may comprise at least one of a displacement detectable spring and a displacement detectable damper.

4. An object moving apparatus as claimed in claim 1, wherein the link mechanism is provided by a spatial parallel linkage comprising a plurality of spatially arranged link members each serving as force sensor and each with one end linked on the side of the carriage body by a universal joint and the other end linked on the side of the lifter by a universal joint, the lifter being arranged on the carriage body through the spatial parallel linkage such that constrained in totally are six degrees of freedom, two degrees of freedom to move in X-Y directions in a horizontal plane, one degree of freedom in the direction to rotate around a Z-axis orthogonal to the X-axis and Y-axis directions, one degree of freedom in a direction to rotate around the X-axis, one degree of freedom in a direction to rotate around the Y-axis and one degree of freedom to move along the Z-axis direction.

5. An object moving apparatus as claimed in claim 4, wherein said link member comprises at least one of a displacement detectable spring and a displacement detectable damper.

6. An object moving apparatus as claimed in claim 1, wherein the traveling wheels of each of said carriage bodies are omni-directional mobile wheels.

7. An object moving apparatus as claimed in claim 6, wherein each of the omni-direction mobile wheel is provided by a mecanum wheel comprising a wheel body circumferentially provided with a plurality of roller shafts tilted at 45° with respect to a wheel axle and with rollers each rotatably fitted over each of the roller shafts.

8. An object moving apparatus as claimed in claim 6, wherein each of the omni-direction mobile wheel comprises a plurality of wheel units provided along the wheel axle, each of the wheel units comprising a wheel body circumferentially provided with a plurality of roller shafts extending tangentially and perpendicular to the wheel axle and with rollers each rotatably fitted over each of the roller shafts.

9. An object moving apparatus as claimed in claim 1, wherein the object is a vehicle and each of the lifters is provided with wheel raising supports each for support of each of the wheels of said vehicle, each of the wheel raising supports comprising:

a pair of rack guide rails secured to extend in parallel with each other within a lifter frame attached to each of the carriage bodies via the link mechanism;

a drive guide rail secured to extend in parallel with said rack guide rails;

a pair of rack members slidably arranged along the rack guide rails and having rack portions vertically confronting each other;

a lift bar opening/closing actuator slidably arranged along said drive guide rail;

a drive pinion meshed with both of the mutually confronting rack portions of the paired of rack members and rotationally driven by said lift bar opening/closing actuator;

lift bars each having a wheel support roller rotatably fitted over the bar and ground support wheels at base and tip ends of the bar and projected one and the other ends of the one and the other rack members at right angles thereto, respectively; and a self-aligned-position retainer arranged for keeping the lift bar opening/closing actuator at a desired position on said drive guide rail;

the paired lift bars of each of the wheel raising supports of the lifter being positioned fore and aft of the corresponding wheel of the vehicle and being adapted to be moved toward each other to lift up the vehicle.

10. An object moving apparatus as claimed in claim 6, wherein the object is a vehicle and each of the lifters is provided with wheel raising supports each for support of each of the wheels of said vehicle, each of the wheel raising supports comprising:

a pair of rack guide rails secured to extend in parallel with each other within a lifter frame attached to each of the carriage bodies via the link mechanism;

a drive guide rail secured to extend in parallel with said rack guide rails;

a pair of rack members slidably arranged along the rack guide rails and having rack portions vertically confronting each other;

a lift bar opening/closing actuator slidably arranged along said drive guide rail;

a drive pinion meshed with both of the mutually confronting rack portions of the paired of rack members and rotationally driven by said lift bar opening/closing actuator;

lift bars each having a wheel support roller rotatably fitted over the bar and ground support wheels at base and tip ends of the bar and projected one and the other ends of the one and the other rack members at right angles thereto, respectively; and a self-aligned-position retainer arranged for keeping the lift bar opening/closing actuator at a desired position on said drive guide rail;

the paired lift bars of each of the wheel raising supports of the lifter being positioned fore and aft of the corresponding wheel of the vehicle and being adapted to be moved toward each other to lift up the vehicle.

11. An object moving apparatus as claimed in claim 7, wherein the object is a vehicle and each of the lifters is provided with wheel raising supports each for support of each of the wheels of said vehicle, each of the wheel raising supports comprising:

a pair of rack guide rails secured to extend in parallel with each other within a lifter frame attached to each of the carriage bodies via the link mechanism;

a drive guide rail secured to extend in parallel with said rack guide rails;

a pair of rack members slidably arranged along the rack guide rails and having rack portions vertically confronting each other;

a lift bar opening/closing actuator slidably arranged along said drive guide rail;

a drive pinion meshed with both of the mutually confronting rack portions of the paired of rack members and rotationally driven by said lift bar opening/closing actuator;

lift bars each having a wheel support roller rotatably fitted over the bar and ground support wheels at base and tip ends of the bar and projected one and the other ends of the one and the other rack members at right angles thereto, respectively; and a self-aligned-position retainer arranged for keeping the lift bar opening/closing actuator at a desired position on said drive guide rail;

the paired lift bars of each of the wheel raising supports of the lifter being positioned fore and aft of the corresponding wheel of the vehicle and being adapted to be moved toward each other to lift up the vehicle.

12. An object moving apparatus as claimed in claim 9, wherein the wheel support roller of the lift bar is anti-slip surface-treated.

* * * * *